US010485395B1

(12) United States Patent
Brady

(10) Patent No.: US 10,485,395 B1
(45) Date of Patent: Nov. 26, 2019

(54) FLOOR MACHINE WITH ATTACHMENT SYSTEM

(71) Applicant: Kevin Douglas Brady, Jonesboro, AR (US)

(72) Inventor: Kevin Douglas Brady, Jonesboro, AR (US)

(73) Assignee: SQUARE SCRUB, L.L.C., Jonesboro, AR (US)

( * ) Notice: Subject to any disclaimer, the term of this patent is extended or adjusted under 35 U.S.C. 154(b) by 561 days.

(21) Appl. No.: 15/190,074

(22) Filed: Jun. 22, 2016

Related U.S. Application Data

(60) Provisional application No. 62/182,756, filed on Jun. 22, 2015.

(51) Int. Cl.

| | |
|---|---|
| ***A47L 11/04*** | (2006.01) |
| ***A47L 11/26*** | (2006.01) |
| ***A47L 11/40*** | (2006.01) |
| ***B08B 7/02*** | (2006.01) |

(52) U.S. Cl.
CPC ..... *A47L 11/4075* (2013.01); *A47L 11/04* (2013.01); *A47L 11/26* (2013.01); *A47L 11/4036* (2013.01); *A47L 11/4072* (2013.01); *B08B 7/02* (2013.01)

(58) Field of Classification Search
CPC ..... A47L 11/04; A47L 11/26; A47L 11/4036; A47L 11/4075
See application file for complete search history.

(56) References Cited

U.S. PATENT DOCUMENTS

| | | | | |
|---|---|---|---|---|
| 4,024,597 | A * | 5/1977 | Fouracre | A47L 11/00 15/28 |
| 5,381,578 | A * | 1/1995 | Armbruster | A47L 11/284 15/145 |
| 5,533,222 | A * | 7/1996 | Lelkes | A46B 13/003 15/230 |
| 6,810,547 | B2 * | 11/2004 | Hung | A47L 11/4075 15/144.1 |
| 8,276,236 | B2 * | 10/2012 | Goodman | A47L 11/38 15/144.1 |
| 2004/0103490 | A1 * | 6/2004 | Long | A47L 11/125 15/22.1 |

* cited by examiner

*Primary Examiner* — Randall E Chin
(74) *Attorney, Agent, or Firm* — Schrantz Law Firm, PLLC; Stephen D. Schrantz

(57) ABSTRACT

The floor machine provides an attachment system capable of securing a handle to the floor machine at multiple locations. A housing of the floor machine provides two attachment bodies located on the exterior of two different walls of the housing. By securing the handle to the different attachment points, the user can configure the footprint of the floor machine to increase the user's access to narrower and/or smaller confined areas.

11 Claims, 34 Drawing Sheets

FLOOR MACHINE WITH ATTACHMENT SYSTEM

CROSS-REFERENCE TO RELATED APPLICATIONS

This application claims priority to and is a continuation in part of U.S. Patent Application No. 62/182,756 filed on Jun. 22, 2015 entitled "FLOOR MACHINE WITH ATTACHMENT SYSTEM."

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

I. Field of the Invention

The present invention is related to a floor machine. More specifically, the present invention is related to a versatile floor machine capable of completing multiple tasks. The versatile floor machine of the present invention can accomplish preparation for re-coating, chemical stripping jobs, polishing, scrubbing, floor cleaning, baseboard cleaning, wall cleaning, carpet cleaning, grout cleaning, finish removal, floor repair, sanding, glue removal, gum removal, epoxy removal, stone polishing, and other floor needs. The versatile floor machine functions on tile, granite, hardwood, stone, carpet, stairs, grout, concrete, and other flooring surfaces.

To increase access to confined and/or narrow spaces, the present invention provides two attachment points for attaching the handle to the floor machine. The footprint of the floor machine is narrower in one direction than the other. By attaching the handle to the different attachment points, the user can configure the width of the footprint in relation to the handle. Such configuration increases the user's access to limited spaces.

The present invention also provides a rolling attachment for cleaning baseboards. The rolling attachment secures the floor machine to a set of wheels to allow side to side movement of the floor machine. The cleaning surface of the floor machine is positioned to clean the base board.

II. Known Art

Patents and patent applications disclosing relevant information are disclosed below. These patents and patent applications are hereby expressly incorporated by reference in their entirety.

U.S. Pat. No. 8,276,236 issued to Goodman et al. on Oct. 2, 2012 ("the '236 patent") teaches a baseboard cleaning apparatus for cleaning a baseboard of a wall extending upright along the wall with respect to a floor includes a cleaning head and a block positioned in either side of a skid plate, and which are connected by a connector that extends through a slot formed in the skid plate. The skid plate taught by the '236 patent has a lower extremity formed with a skid, and the connector is movable along the slot between lowered positions of the baseboard cleaning head and the fixture toward the skid formed in the lower extremity of the skid plate, and raised positions of the baseboard cleaning head and the fixture away from the skid formed in the lower extremity of the skid plate.

U.S. Pat. No. 7,418,758 issued to Avila on Sep. 2, 2008 teaches an apparatus for cleaning a baseboard of a wall generally comprises an extendable handle to which a friction decreasing device such as a wheel, an adsorbent/desorbent pad and a pad compression device are assembled in a manner such that the lower end of said apparatus can be immersed in a bucket of water.

U.S. Pat. No. 7,296,943 issued to Sandoval on Nov. 20, 2007 ("the '943 patent") teaches an apparatus for cleaning a baseboard of a wall that may include pads and a handle. A front surface of at least one of the pads taught by the '943 patent may be configured to contact a portion of the baseboard during use. A liquid dispenser taught by the '943 patent may be provided to wet one or more of the pads during use. A portion of the handle taught by the '943 patent may be angled to extend away from the wall and rearward from the pad during use. Top pads taught by the '943 patent may be provided for cleaning a top face of the baseboard. The top pads taught by the '943 patent may be vertically and horizontally adjustable relative to a holder to accommodate baseboards of various dimensions.

U.S. Pat. No. 5,533,222 issued to Lelkes et al. on Jul. 9, 1996 ("the '222 patent") teaches a floor machine for cleaning a floor and/or wall and/or downward upstanding from the wall, includes at least one disc having a floor cleaning pad covering a lower surface and wall cleaning material projecting from its periphery. The wall cleaning material taught by the '222 patent may be bristles or a wrap-around separate strip of abrasive felted material, or a margin of the floor cleaning pad may be bent upwardly to form a vertical cylindrical surface. Alternatively, floor pads taught by the '222 patent may be stacked to present a vertical cylindrical wall cleaning surface. The disc taught by the '222 patent may be engaged with a drive shaft, or stacked discs may interengage with each other, the topmost being engaged with the drive shaft. The bottom disc taught by the '222 patent may have a bevel rising from the lower surface. Bristles taught by the '222 patent extend from the bevel at right angles. When the floor machine rests on the floor in operation position, the bristles extending from the bevel taught by the '222 patent are bent upwardly to be forced towards the angle between floor and wall.

U.S. Pat. No. 5,331,703 issued to Mejia et al. on Jul. 26, 1994 teaches a power driven floor and baseboard scrubber is provided having reciprocating plates with scrubbing pads thereon arranged to clean an area at an intersection of the floor and the baseboard, on a stair step and its riser. A handle taught by the '703 patent is provided for operational purposes and wheels for transportation.

U.S. Pat. No. 5,173,985 issued to Palmer on Dec. 29, 1992 ("the '985 patent") teaches a foot mounted scrubber device is provided for use in scrubbing and cleaning selected problem areas of a floor, and along adjacent baseboard surfaces and the like. The scrubber device taught by the '985 patent comprises a relatively flat sole plate, in combination with a toe upper and an elastic heel strap for securely mounting the sole plate onto a shoe in a position underlying the ball region and toes of a user's foot. The sole plate taught by the '985 patent defines an abrasive scrubber surface which can be applied against a problem area to be cleaned through the use of the leg muscles in combination with the user's body weight. In a preferred form, the '985 patent teaches that the sole plate and toe upper cooperatively define a pointed forward toe lined with an abrasive scrubber material for use in cleaning baseboard surfaces and corners and the like along the edge of the floor.

U.S. Pat. No. 4,024,597 issued to Fouracre on May 24, 1977 teaches a housing that contains a motor driven by an electrical source and a shaft connected to the motor drives a brush which can clean a tile floor while a bevelled gear attached to the shaft may drive a second bevelled gear connected to a perpendicular shaft which passes through the housing, a brush attached to the perpendicular shaft may clean a sideboard while if the edge of the sideboard cleaning brush is bevelled then the baseboard cleaning brush may also clean the bevelled corner between the floor and the baseboard.

U.S. Publication No. 20130061414 to Swist on Mar. 14, 2013 ("the '414 publication") teaches a cleaning system that is provided comprising a compliant pad and a consumable pad for use in conjunction with a variety of cleaning implements. The compliant pad taught by the '414 publication may according to embodiments of the invention provide for both compliance to the contour of the surface being cleaned but also allows for the compliant pad to provide for controlled release of fragrance, solvents, cleaning agents etc within the matrix or matrices provided in its construction. Likewise the consumable pad taught by the '414 publication may provide elements providing dust attraction/retention, abrasion, as well as controlled release of fragrance, solvents, cleaning agents etc within the materials provided in its construction. According to embodiments of the invention the compliant pad and/or consumable pad taught by the '414 publication are water soluble to provide this release wherein the water is provided either from within one or both of the compliant pad and consumable pad or from the cleaning implement to which they are attached.

U.S. Publication No. 20110191972 issued to Goodman on Aug. 11, 2011 ("the '972 publication") teaches a baseboard cleaning apparatus for cleaning a baseboard of a wall extending upright along the wall with respect to a floor includes a cleaning head and a block positioned in either side of a skid plate, and which are connected by a connector that extends through a slot formed in the skid plate. The skid plate taught by the '972 publication has a lower extremity formed with a skid, and the connector is movable along the slot between lowered positions of the baseboard cleaning head and the fixture toward the skid formed in the lower extremity of the skid plate, and raised positions of the baseboard cleaning head and the fixture away from the skid formed in the lower extremity of the skid plate.

U.S. Publication No. 20080145132 to Sandoval on Jun. 19, 2008 ("the '132 publication") teaches a device for cleaning trim of a room includes a head and a handle. The head taught by the '132 publication includes at least one first cleaning portion that can clean a first surface of the trim by moving the head in a lengthwise direction of the trim and at least one second cleaning portion that can clean a second surface of the trim by moving the head lengthwise direction of the trim, the second surface being above the first surface and not co-planar with the first surface. The head includes a removable cover. At least part of the first cleaning portion and at least part of the second cleaning portion are formed in the removable cover taught by the '132 publication.

U.S. Publication No. 20040083579 to Furr-Britt on May 6, 2004 ("the '579 publication") teaches a dual handle attachment for a floor appliance, e.g., vacuum cleaner, large push broom, mop, squeegee, etc., allows a user of the appliance to manipulate or maneuver the appliance using generally symmetrical upper body, arm, wrist, and hand forces and movements, thereby obviating the need for asymmetrical twisting and the greater strength required to manipulate such a device using only a single arm and hand. The present attachment taught by the '579 publication comprises a single central bracket which attaches to the conventional single handlebar of such an appliance, with a left and a right handgrip adjustably extending from the central bracket. The two handgrips taught by the '579 publication may be pivotally adjusted by the user as desired, and may be interchanged for handgrips having different shapes or configurations as desired. One embodiment taught by the '579 publication may be removably secured to the appliance, with another embodiment providing for permanent attachment as an integral part of the appliance at the time of manufacture.

SUMMARY OF THE INVENTION

The present invention is related to a floor machine for re-coating, stripping, polishing, scrubbing, cleaning, finish removal, floor repair, sanding, and other floor needs. The present invention provides a handle attached to a motor and housing. A floor preparation body attaches to the housing for treatment of the flooring. The preparation body varies according to the desired task to be accomplished by the floor machine. The shaft of the motor attaches to an eccentric to offset position to revolve the preparation body around the offset attachment. The motor revolves the preparation body to complete the desired task on the floor. Such attachment appears to vibrate the preparation body. In another embodiment, the motor vibrates the preparation body.

The housing also provides a first retention finger and a second retention finger extending vertically above the top of the housing. Slotted weights are secured onto the retention fingers to increase the weight of the present invention for treatment of the floor The housing also provides a first attachment body and a second attachment body for securing the handle. The attachment bodies are located on different sides of the housing to adjust the configuration of the floor machine. The housing of one embodiment provides a bottom gripping surface that forms a rectangle. In such an embodiment, the length of the bottom gripping surface is different than the width of the bottom gripping surface. The multiple attachment bodies enable the handle to attach to different points of the housing. The different attachment points enable the floor machine to access areas that would not be accessible when the handle is attached to the other attachment body.

The multiple attachment bodies also provide increased functionality to the floor machine. The user can attach the handle to one attachment body for using the floor machine on the floor. The multiple attachment bodies enable the user to orient the floor machine according to the user's preferences. The additional attachment body enables the user to attach to a rolling attachment. Attaching the floor machine to the rolling attachment orients the floor machine differently for increased functionality. The multiple attachment bodies enable the floor machine to be used for treating floors. The user can then reorient the floor machine using the attachment body to treat walls, baseboards, and other surfaces.

The different attachment points also enable the floor machine to attach to a rolling attachment for side to side movement. The rolling attachment supports the floor machine above the ground to allow for simpler movement. The rolling attachment also orients the driver plate from a downward position to a forward position. Orienting the driver plate in the forward position directs the preparation body toward the wall and baseboards.

It is an object of the present invention to provide a versatile floor machine capable of accomplishing multiple tasks.

It is another object of the present invention to provide a motor attached to a housing.

It is another object of the present invention to offset the attachment of the motor with the preparation body.

It is another object of the present invention to vary the weight of the floor machine by adding or removing slotted weights on to the retention fingers extending vertically above the housing of the floor machine.

It is another object of the present invention to provide a gripping surface for attaching the preparing body for performing the desired function on the floors.

It is another object of the present invention to provide multiple attachment bodies for securing a handle to the floor machine.

It is another object of the present invention to provide attachment points at different locations on the floor device to adjust the alignment of the handle on the machine.

It is another object of the present invention to increase the access of the floor machine into difficult to reach areas.

It is another object of the present invention to provide a rolling attachment to simplify movement of the floor machine.

It is another object of the present invention to position the floor machine on its side to direct the finishing surface towards the baseboards.

These and other objects and advantages of the present invention, along with features of novelty appurtenant thereto, will appear or become apparent by reviewing the following detailed description of the invention.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
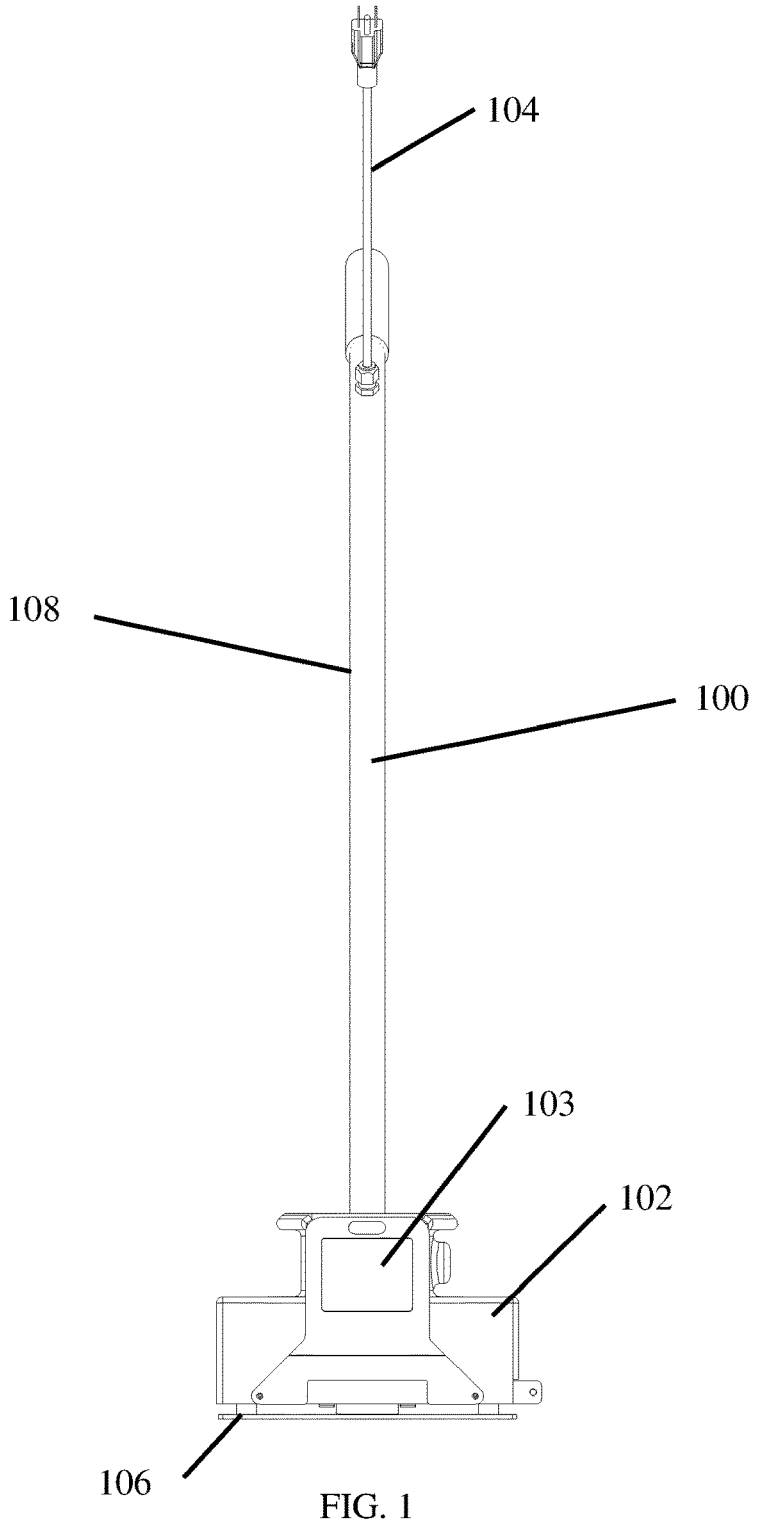
FIG. 1 is a front environmental view of one embodiment of the present invention.
Figure 2A:
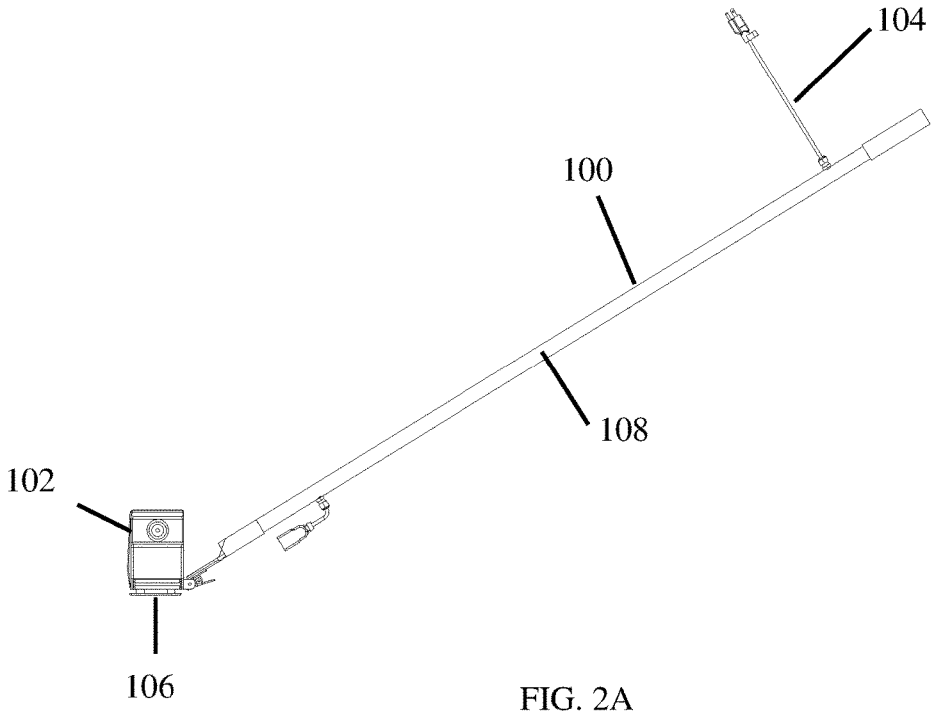
FIG. 2A is a right side view thereof.
Figure 2B:
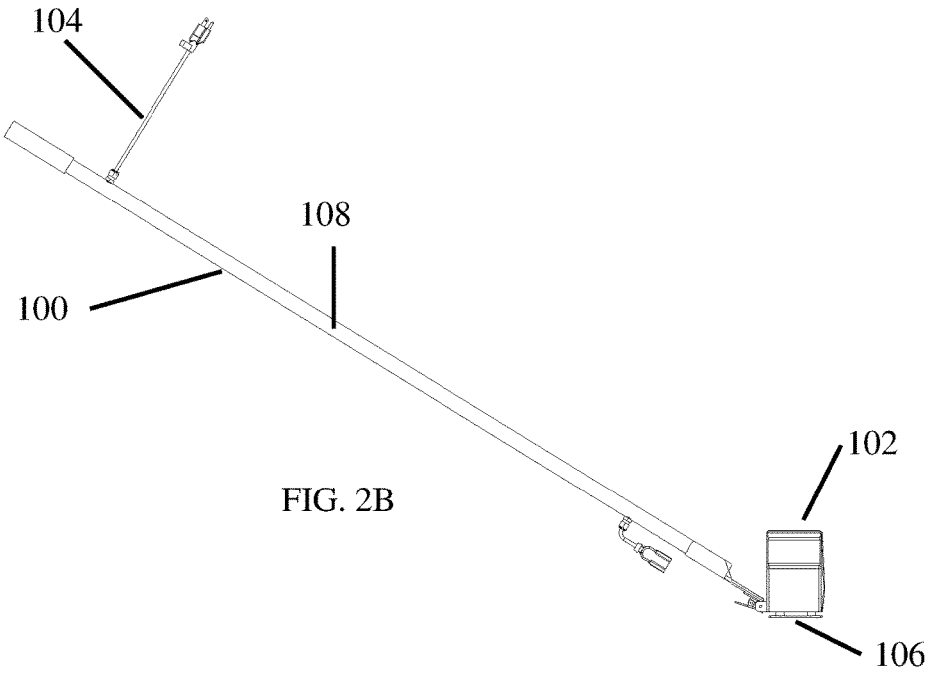
FIG. 2B is a left side view thereof.
Figure 3:
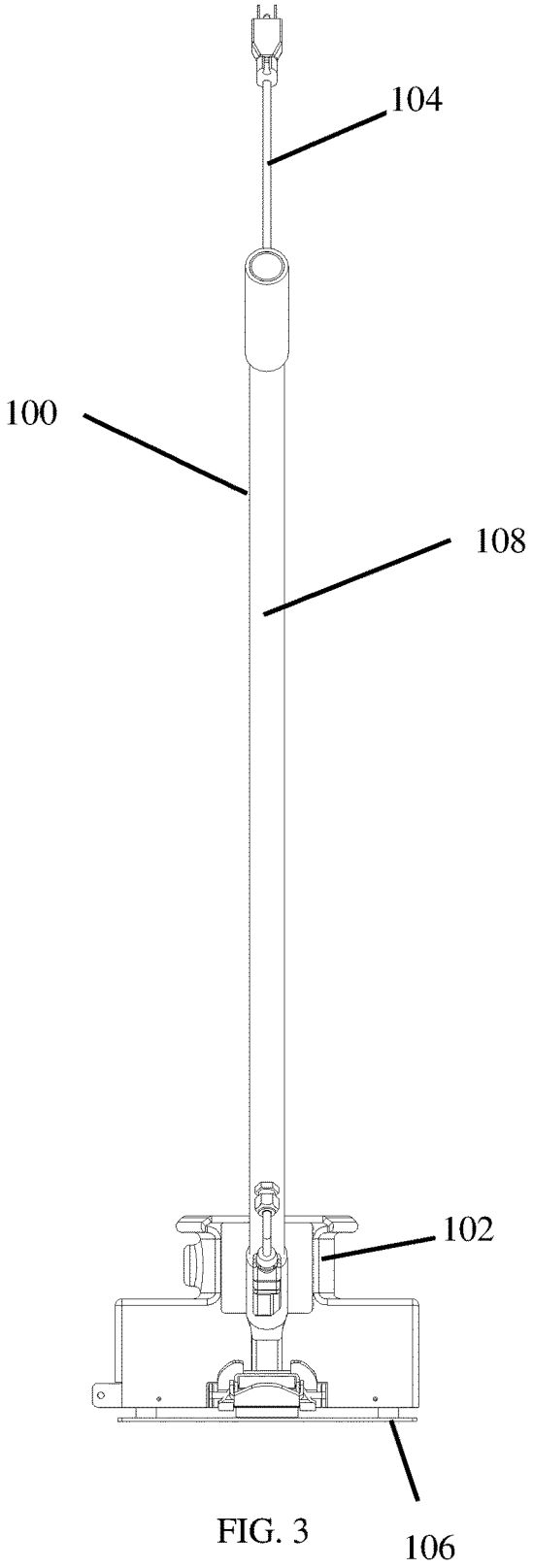
FIG. 3 is a rear view thereof.
Figure 4:
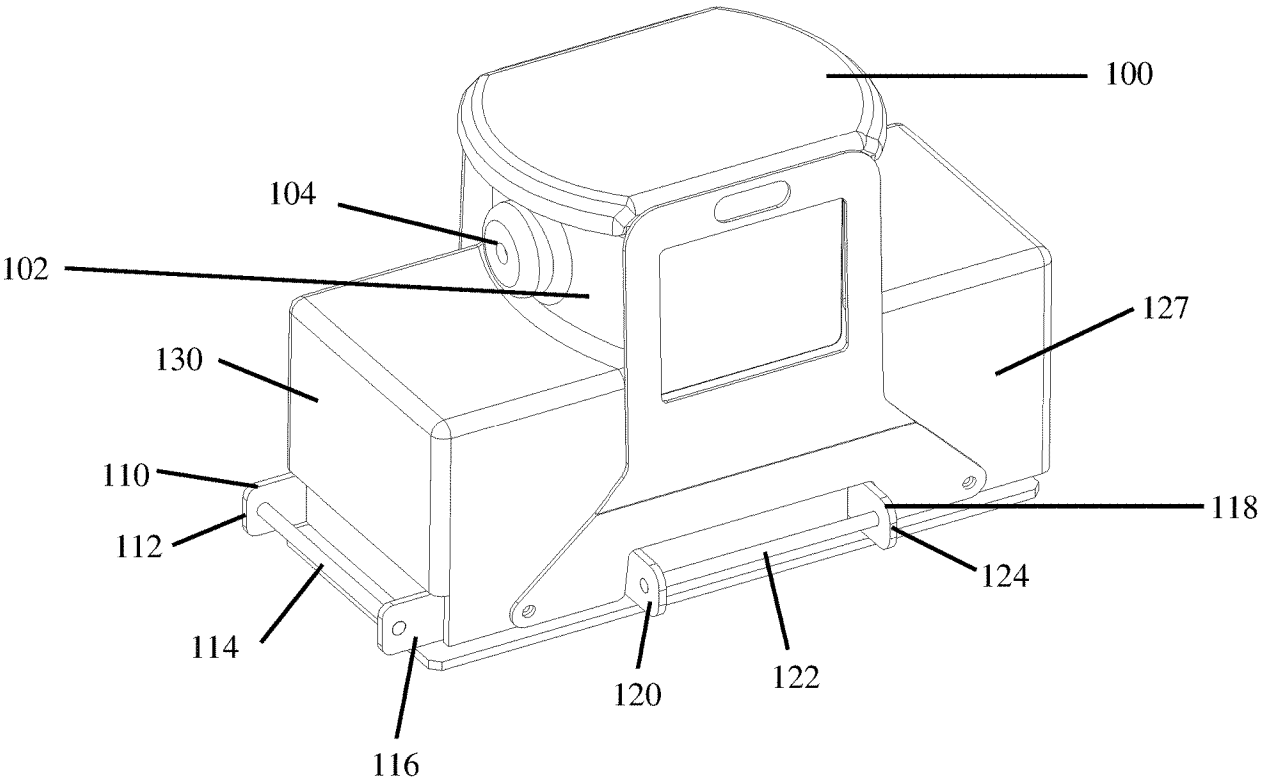
FIG. 4 is a rear perspective view thereof.

FIGS. 1-3 show the floor machine 100 with multiple attachment bodies located on different sides of housing 102. The multiple attachment bodies provide different attachment points for securing the handle 108 to housing 102 in different orientations. In one embodiment, attaching the handle 108 to the different attachment points changes the orientation with the handle by 90 degrees. Power cord 104 is plugged into a power source that powers the motor 103. The motor 103 revolves housing 102 and the driver plate 106 that secures to the preparation body.

The preparation body secures to the driver plate 106 for contacting the floor. Different types of preparation bodies may attach to the housing depending on the floor surface and the task to be completed. Examples of preparation bodies may include an SQP pad, an SHO pad, a microfiber pad, a wet pad, a tile and grout wet pad, a scrubber, a scrub brush, a tile and grout brush, a carpet cleaning pad, a sandscreen, sandpaper, an abrader plate, stone polishing pads, vacuum braised diamond, resin diamonds, polypads, polishing pads, tooltip diamonds, a sponge, and an enhancer pad, as well as other floor treatment materials. In one embodiment, a gripping surface that includes protrusions, hooks, fasteners, loops, grips, or other fasteners is located on the bottom surface of the driver plate 106. The preparation body then attaches to the gripping surface.

Figure 12:
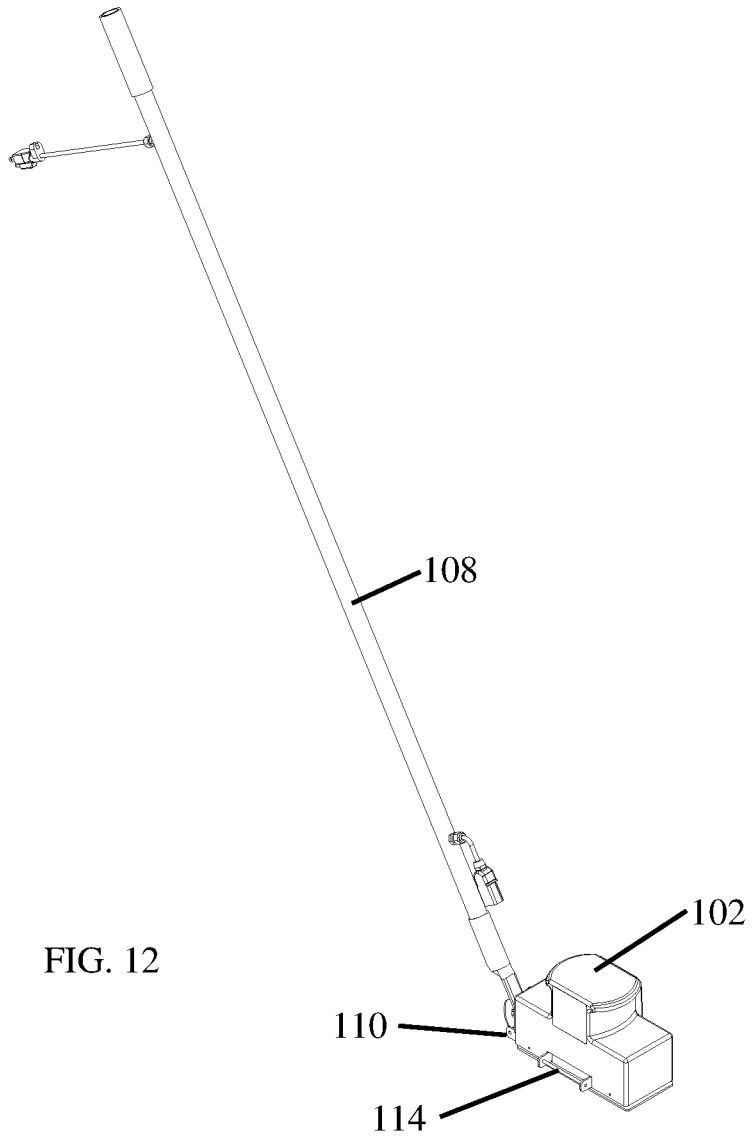
FIG. 12 is an environmental view thereof.
Figure 13:
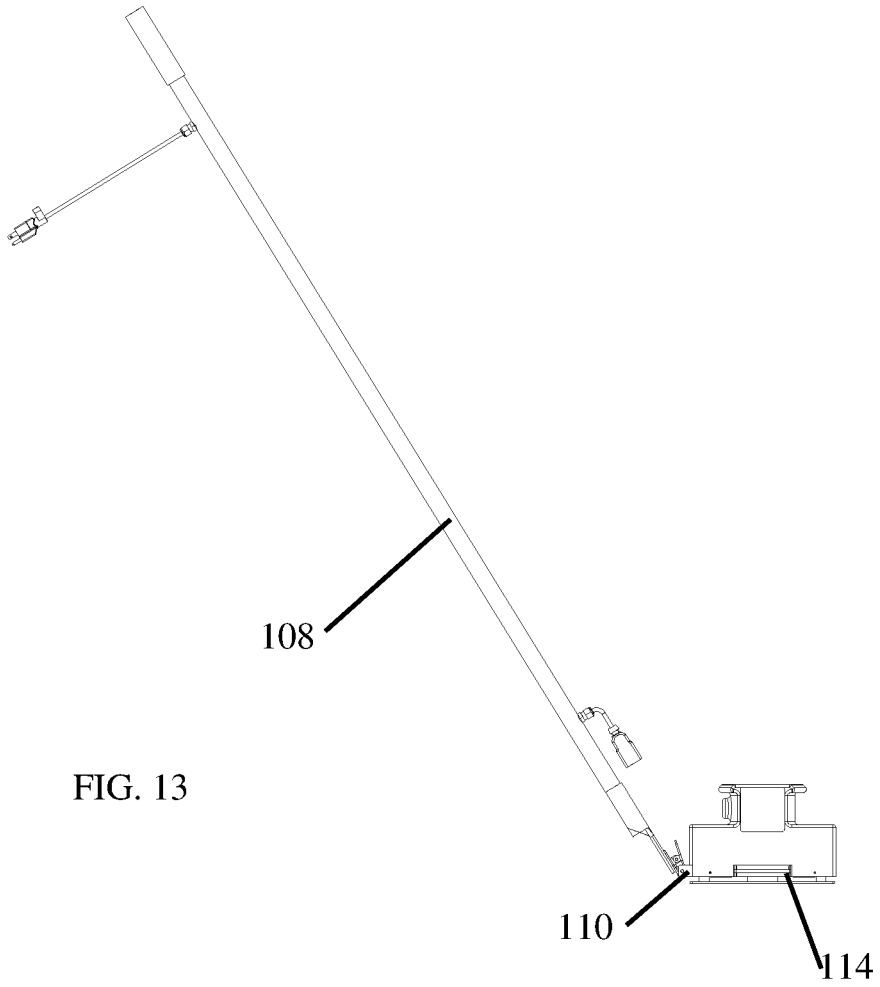
FIG. 13 is a front view thereof.

FIGS. 1-3 and FIGS. 12-13 show the different attachments of the handle 108 to housing 102 to adjust the orientation of the driver plate 106 in relation to the handle 108. The handle 108 releasably attaches to the housing 102 so that the housing 102 and handle 108 can form at least two different configurations. FIGS. 1-3 show the handle 108 attached to the attachment body 118 at the rear wall 127 of the housing 102. FIGS. 12-13 show the handle 108 attached to the attachment body 110 at the side wall 130.

The handle 108 attaches to one of the attachment bodies located on the rear wall and the side wall. If the user needs to adjust the configuration of the floor machine 100, the user simply removes the handle 108 from one attachment body and reconnects the handle at another attachment body. Such configurability of the attachment of the handle 108 with the housing 102 increases the functionality of the floor machine 100 and increases access to the difficult to reach areas.

FIG. 1 shows a front view with the housing 102. The user attaches the handle 108 to the attachment body located at the rear wall to increase the width of the cleaning surface. In one embodiment, the width of the driver plate 106 is greater than the depth of the driver plate 106. Such differences in sizes enables attachment of preparation bodies of different depth and width to the driver plate 106.

FIGS. 4-9 show more detailed views of the floor machine 100 and the housing 102. The power cord 104 secures to the motor within housing 102 to power the motor. One embodiment of the present invention provides two attachment bodies 110, 118. Attachment body 110 is located on side wall 130. Attachment body 118 is located on rear wall 127.

Each attachment body 110, 118 provides attachment shoulders 112, 116, 120, 124 that extend laterally from the wall of the housing 102. The attachment shoulders 112, 116, 120, 124 limit lateral movement of the handle 108 in relation to the housing when the handle is attached to the housing 102.

An attachment neck 114, 122 is located between the attachment shoulders 112, 116, 120, 124. An attachment head of the handle 108 attaches to the attachment neck 114, 122 to secure the handle 108 to the housing 102. The attachment neck 114, 122 extends longitudinally along the wall to which the respective attachment body is secured. The attachment neck 114, 122 provides an attachment aperture between the attachment neck and the wall to which the attachment body is secured.

Figure 5:
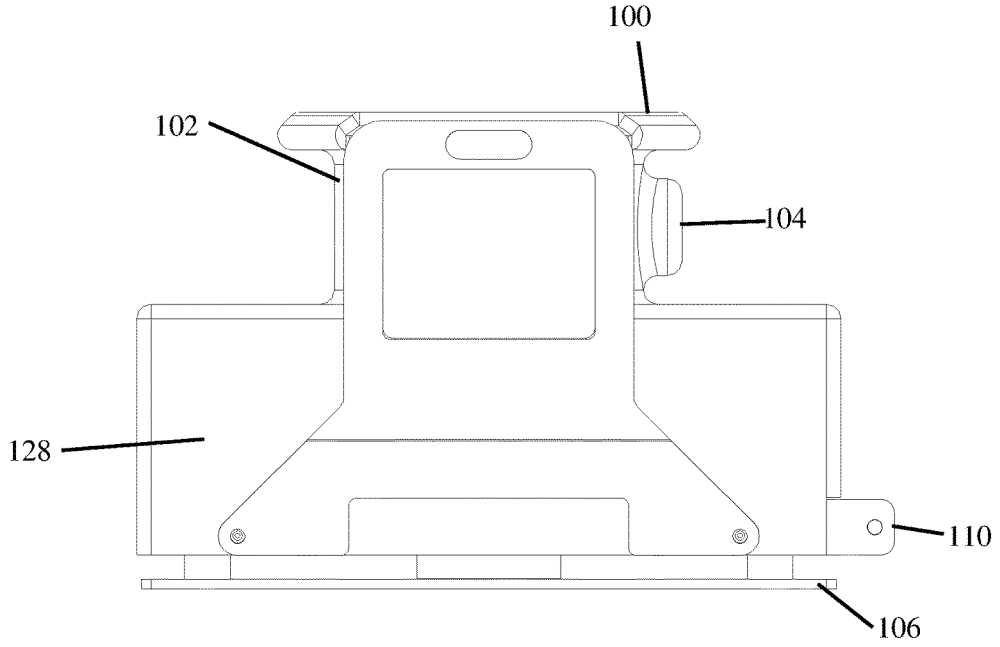
FIG. 5 is a front view thereof.

FIG. 5 shows the front wall 128 of the housing 102 of the floor machine 102. Attachment body 110 is located on one of the side walls in relation to front wall 128.

Figure 6:
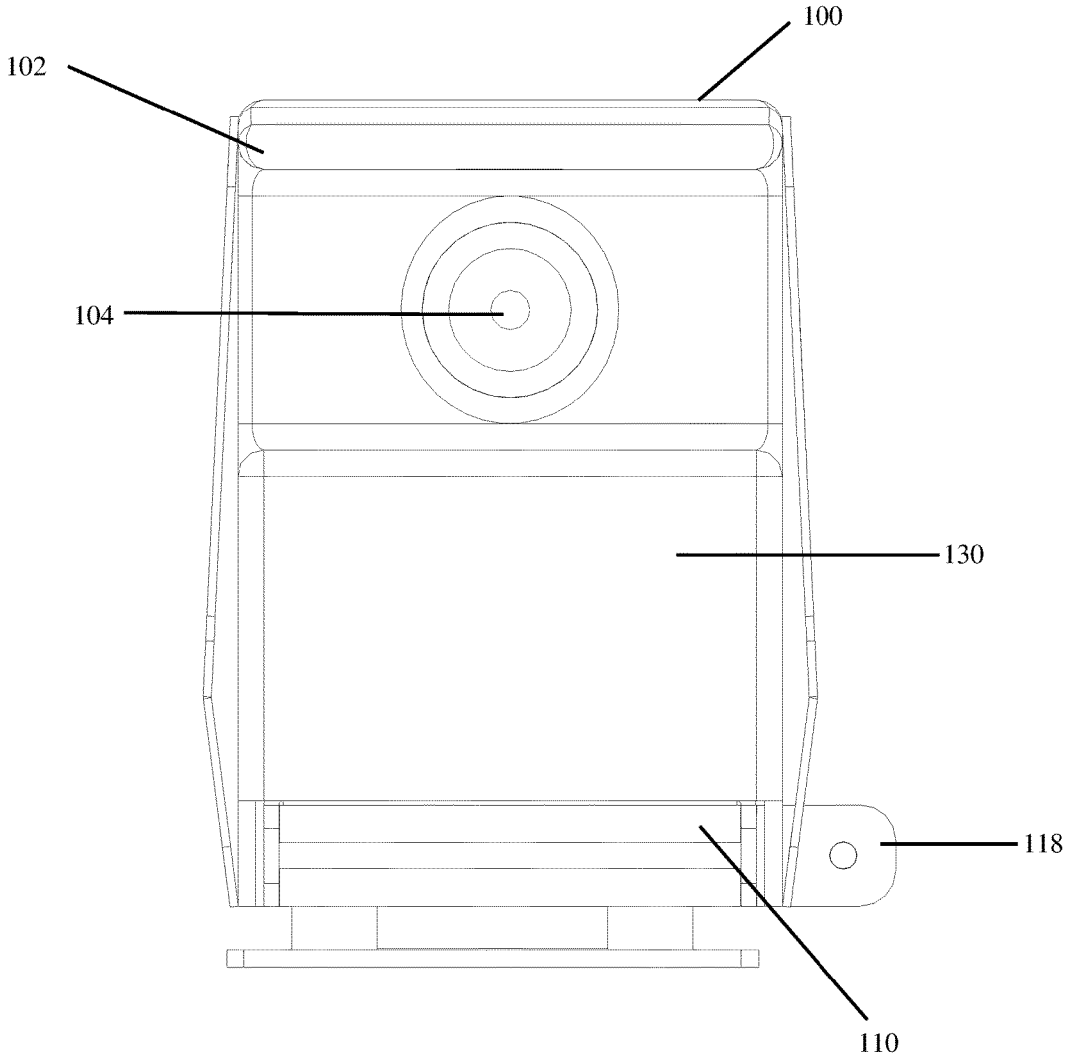
FIG. 6 is a right side view thereof.

FIG. 6 shows the side wall 130 and attachment body 110 extending laterally from side wall 130. The housing 102 also provides an opening for the power cord 104 to enter the housing to power the motor and the floor machine 100. FIG. 6 also shows attachment body 118 to show the two different attachment points, attachment body 110 and attachment body 118, for securing the handle to the housing 102.

The user can attach the handle to the different attachment points to change the configuration of the preparation body and the driver plate in relation to the handle. Changing the configuration of the preparation body in relation to the handle alters operation of the floor machine. If the user needs access to narrower spaces, the user may attach the handle to attachment body 110 for use of the floor machine 100. If the user requires larger surface coverage, the user attaches the handle to attachment body 118 to increase the width of the surface treated with each push/pull of the handle 108.

Figure 7:
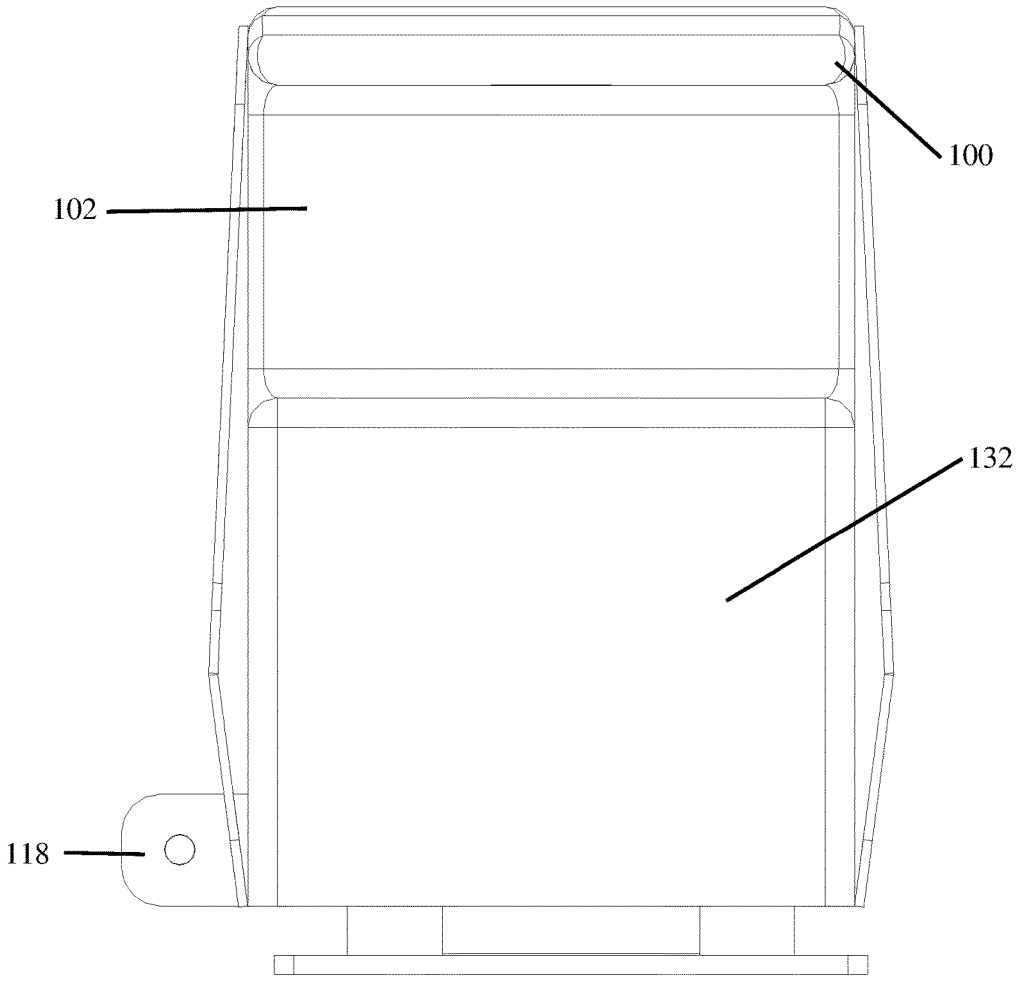
FIG. 7 is a left side view thereof.

FIG. 7 shows side wall 132 of housing 102 of the floor machine 100. FIG. 7 also shows attachment body 118 and its relation to the side wall 132.

Figure 8:
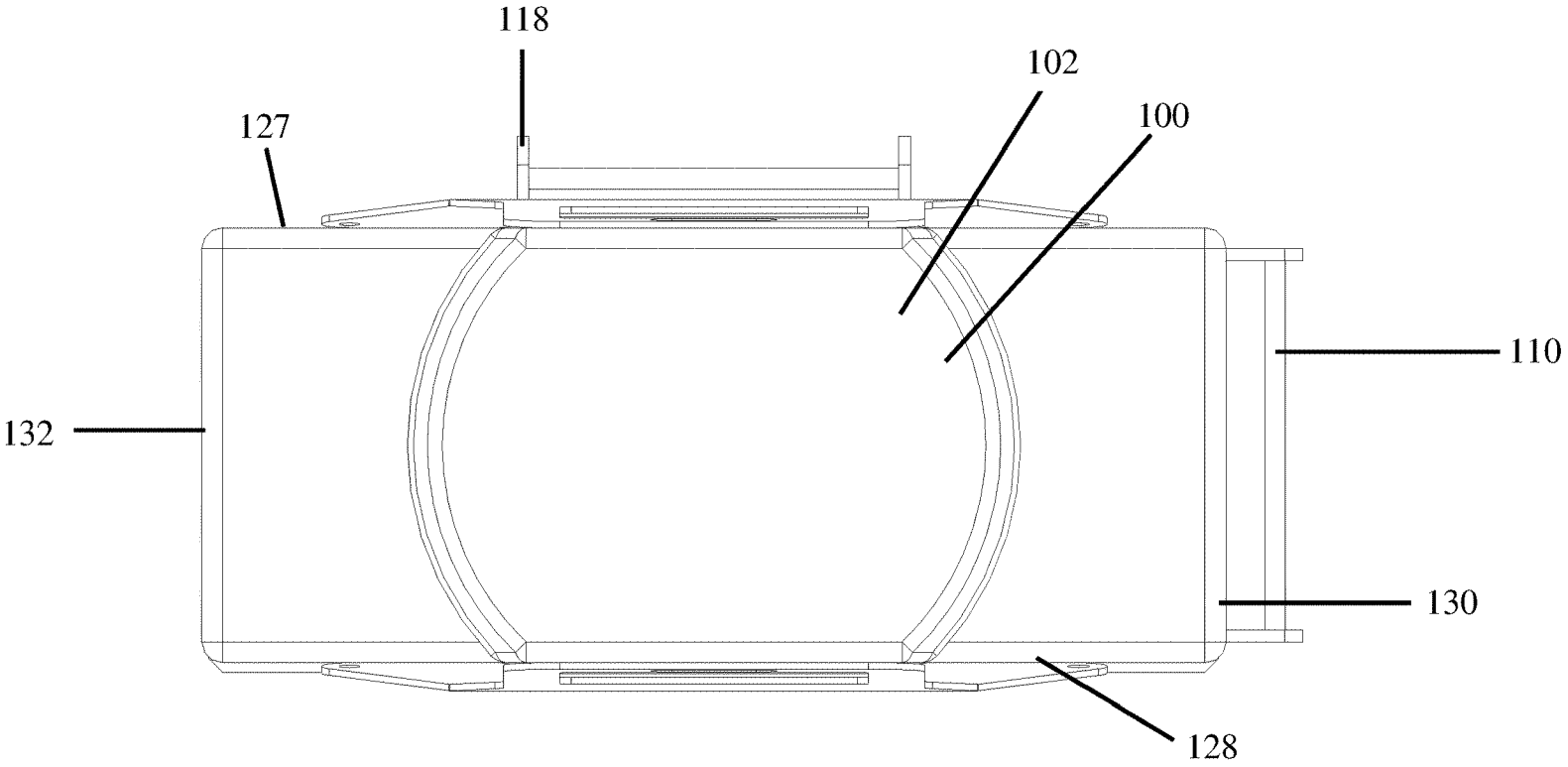
FIG. 8 is a top view thereof.

FIG. 8 shows a top view of the housing 102 and floor machine 100. The width of the housing 102, the distance from side wall 130 to side wall 132, is greater than the depth of the housing 102, the distance from front wall 128 to rear wall 127. By attaching the handle to the attachment body 110, the user can configure the floor machine to have a narrower footprint to gain access to narrower areas. The user can increase the width of the footprint by attaching the handle to the attachment body 118.

Figure 9:
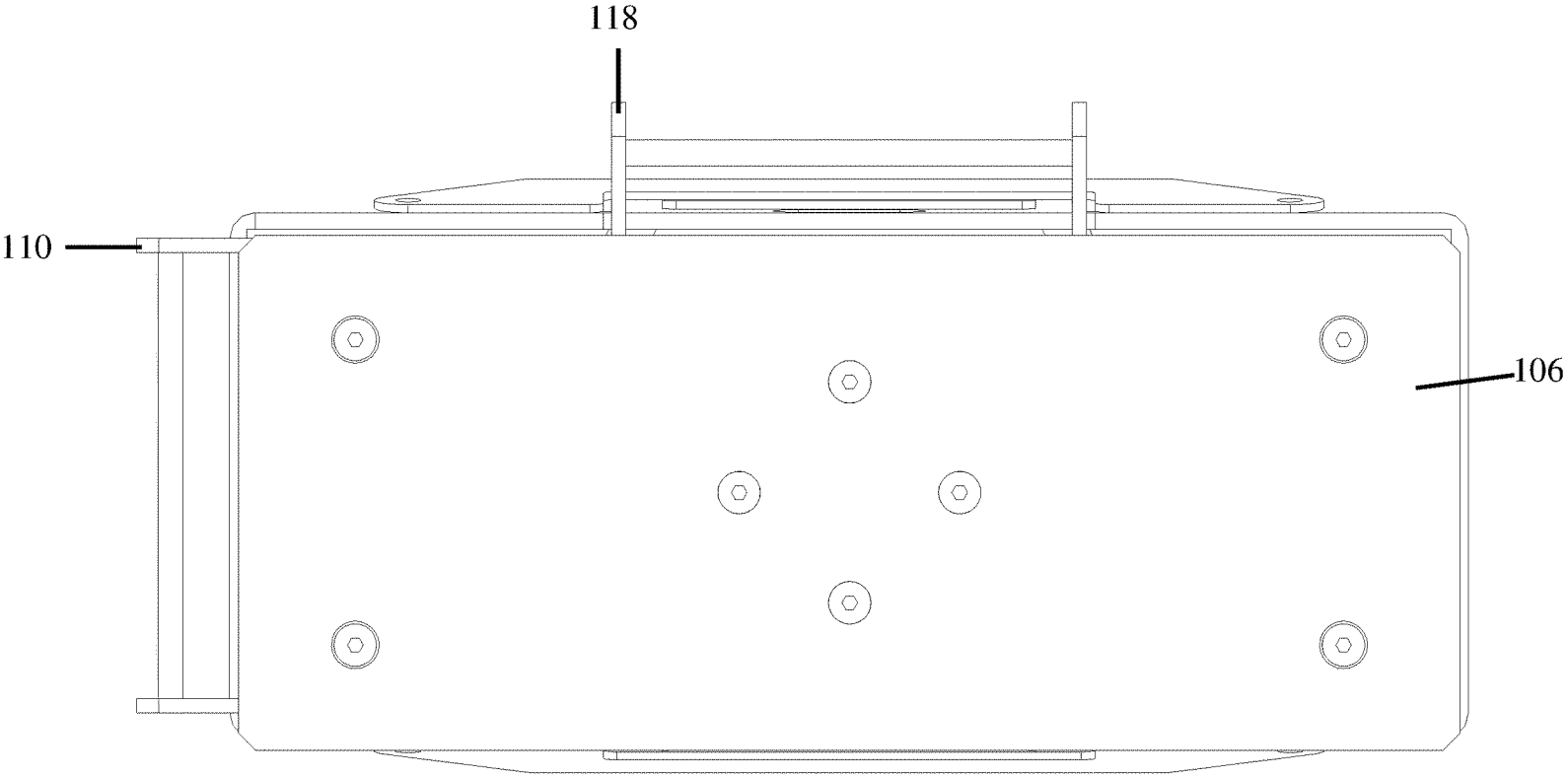
FIG. 9 is a bottom view thereof.
Figure 33:
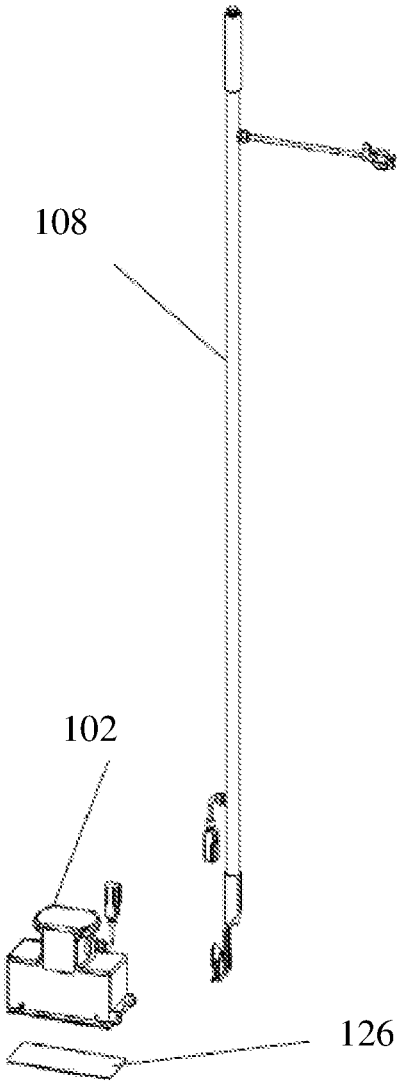
FIG. 33 is an exploded view of one embodiment of the present invention.

FIGS. 9 and 33 show the driver plate 106 to which the gripping surface 126 attaches as shown in FIG. 33. Gripping feet extend from the gripping surface 126. The gripping feet provide protrusions extending laterally from the gripping surface 126 to secure a preparation body to the gripping surface 126. FIG. 9 also shows the attachment bodies 110, 118 in relation to the driver plate 106 and the gripping surface to emphasize the user's ability to configure the footprint of the floor machine 100 through attachment of the handle.

FIG. 9 also shows the bottom of the driver plate 106 at which the bottom gripping surface is located. The bottom gripping surface provides a surface to which the preparation body attaches. The bottom gripping surface is located on the bottom of the housing 102 and secures the preparation body to the driver plate 106 and the floor machine 100.

Figure 10:
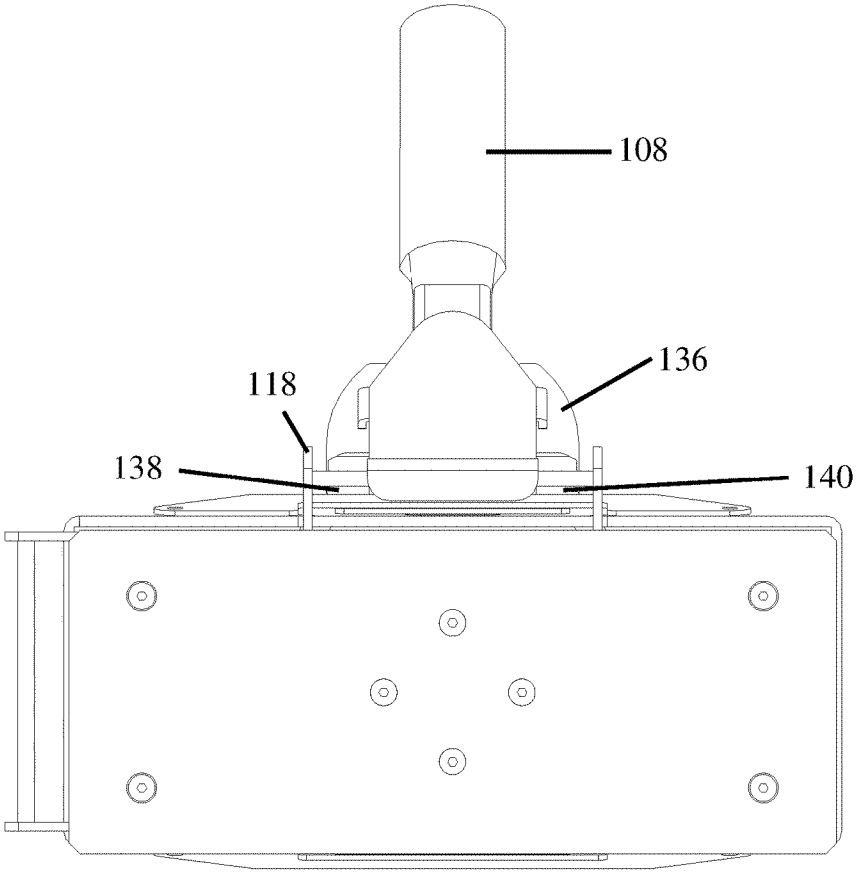
FIG. 10 is a bottom view thereof.
Figure 11:
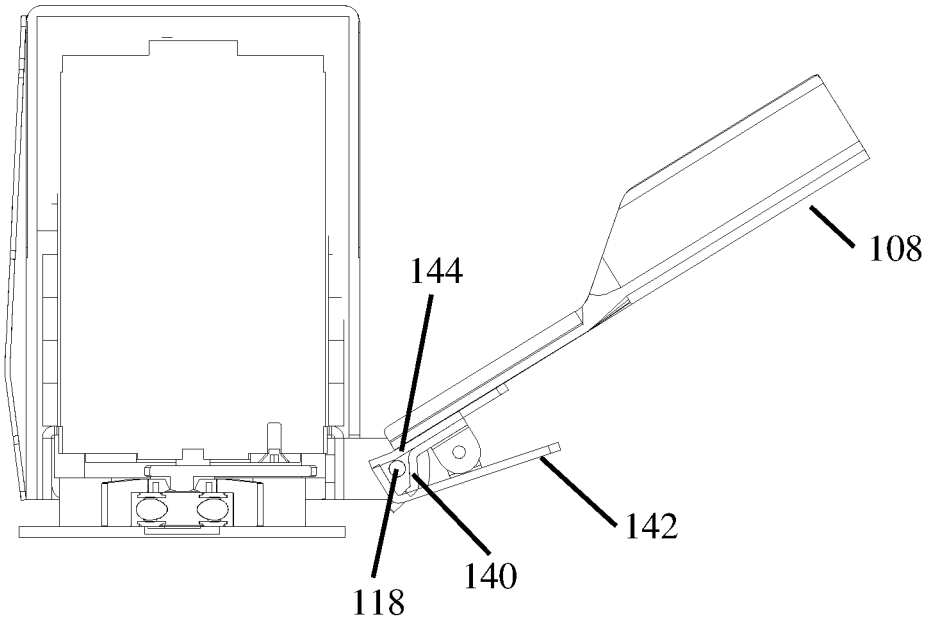
FIG. 11 is a sectional view thereof.

FIGS. 10-11 show the attachment of handle 108 to attachment body 118. The handle 108 attaches to one attachment body 118 at a time. The attachment head 136 provides an upper jaw 142 and a lower jaw 144 that clip around the attachment neck, such as a pin, bar, rod, or other fastener. Attachment teeth 138, 140 secure to lower jaw 144 and extend vertically upward from lower jaw 144 towards upper jaw 142. The attachment teeth 138, 140 create an opening located between the lower jaw 144 and the attachment teeth 138, 140. The attachment neck of attachment body 118 is then placed within the opening below the attachment teeth 138, 140 between the attachment teeth 138, 140 and lower jaw 144.

The upper jaw 142 and lower jaw 144 are then adjusted to the closed position to secure the handle to the housing. In one embodiment, the upper jaw 142 and lower jaw 144 are biased to the closed position to secure the handle to the closed position. The user can adjust the upper jaw 142 and lower jaw 144 to the open position to release the handle from the housing.

FIGS. 12 and 13 show the handle 108 secured to the attachment body 110 of housing 102. Attachment of the handle 108 to adjustment body 110 adjusts the orientation of housing 102 in relation to the handle 108. The differences in the orientation of the housing 102 in relation to the handle 108 are demonstrated at FIGS. 12-13 and FIGS. 1-3. FIGS. 1-3 show the handle 108 secured to adjustment body located on the rear wall 127.

Figure 14:
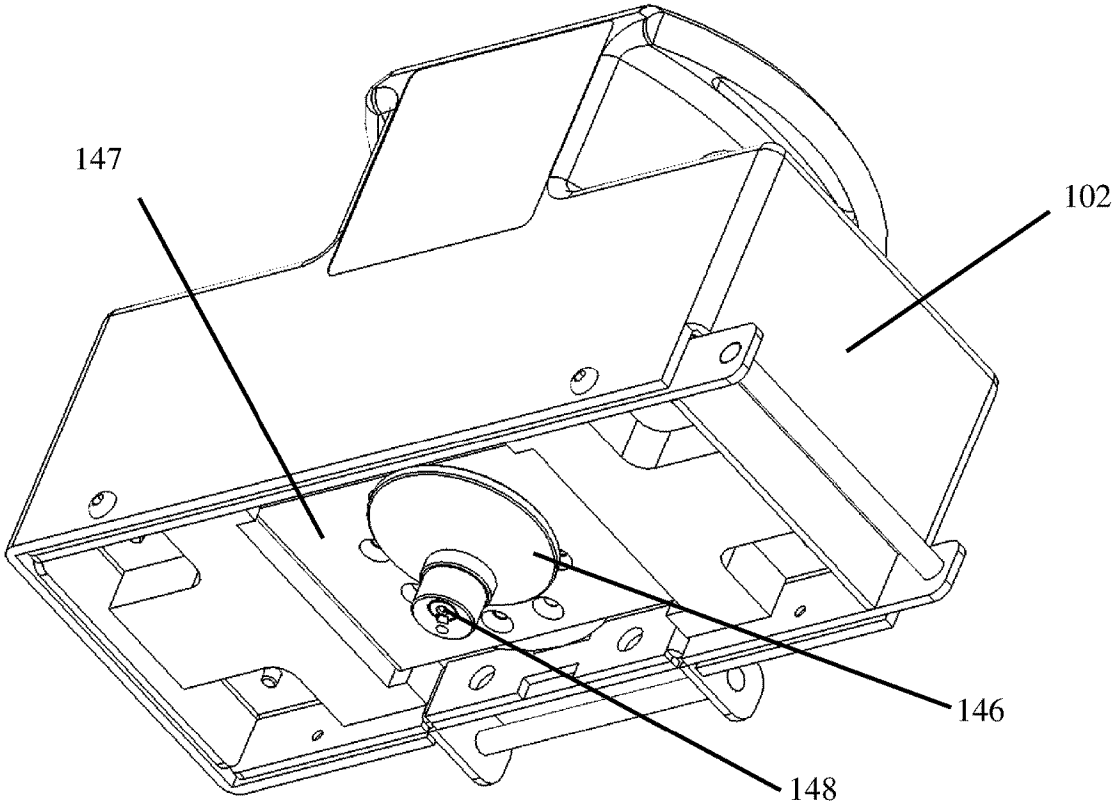
FIG. 14 is a bottom partial view thereof.

FIG. 14 shows a bottom view of the housing 102 in which the driver plate 106 has been removed to show the eccentric assembly 146 and shaft fastener 148. The bearing cup of the eccentric assembly 146 attaches to driver plate 106. Eccentric assembly 146 offsets the attachment of the driver plate 106 with the motor. Shaft fastener 148 secures the eccentric assembly 146 with the motor. Offsetting shaft fastener 148 in relation to the driver plate 106 enables the driver plate to revolve around the shaft fastener 148.

Figure 15:
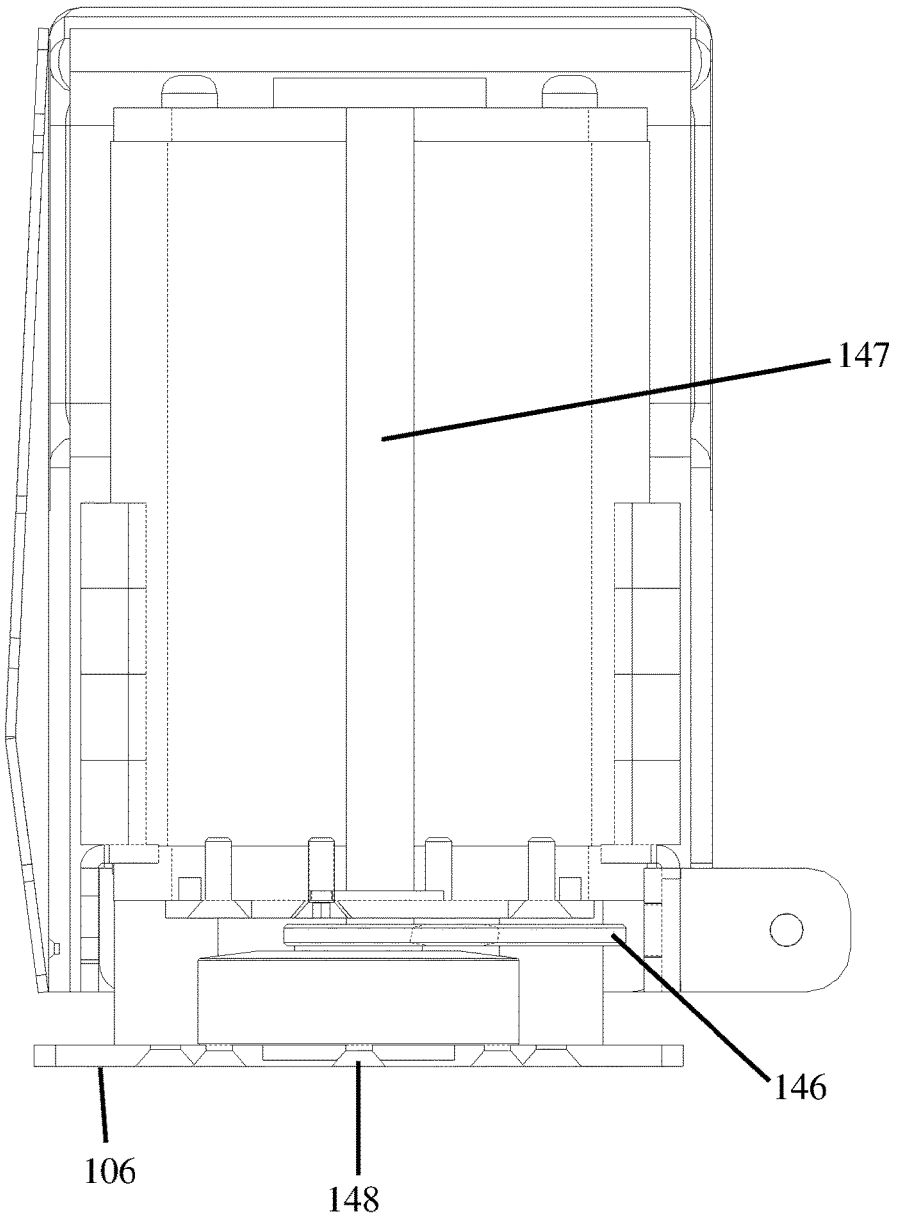
FIG. 15 is a sectional view thereof.
Figure 16:
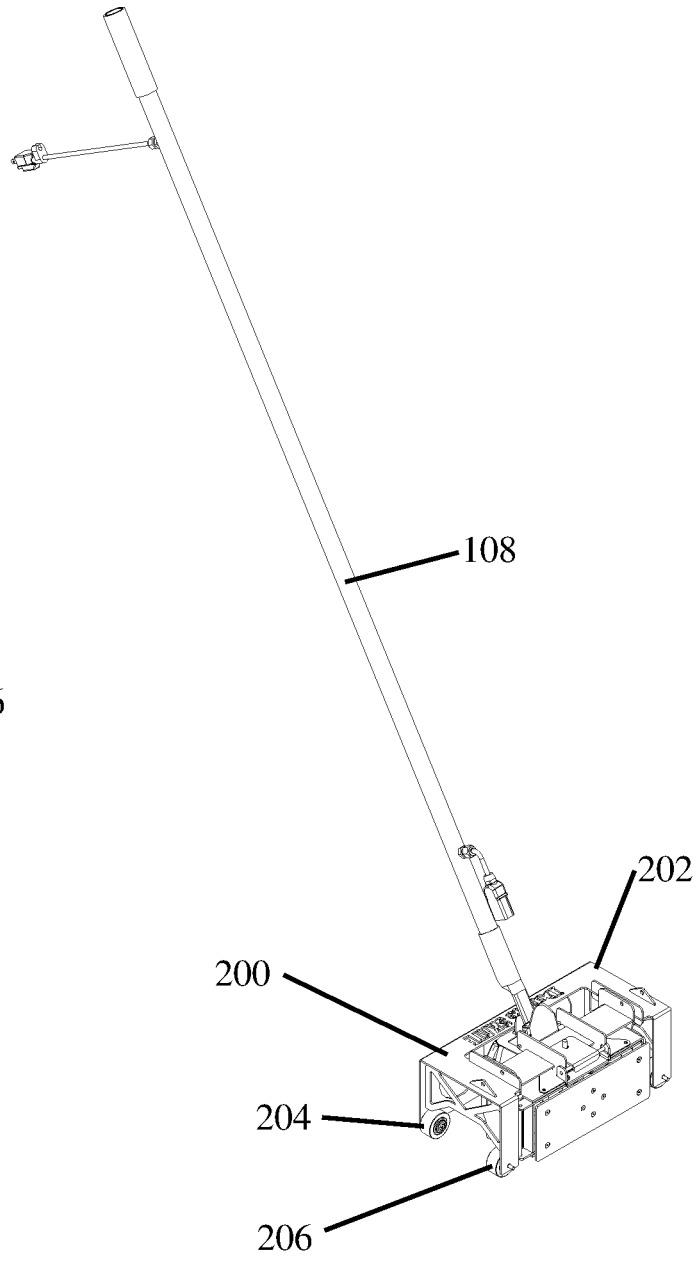
FIG. 16 is an environmental view of one embodiment of the present invention.
Figure 17:
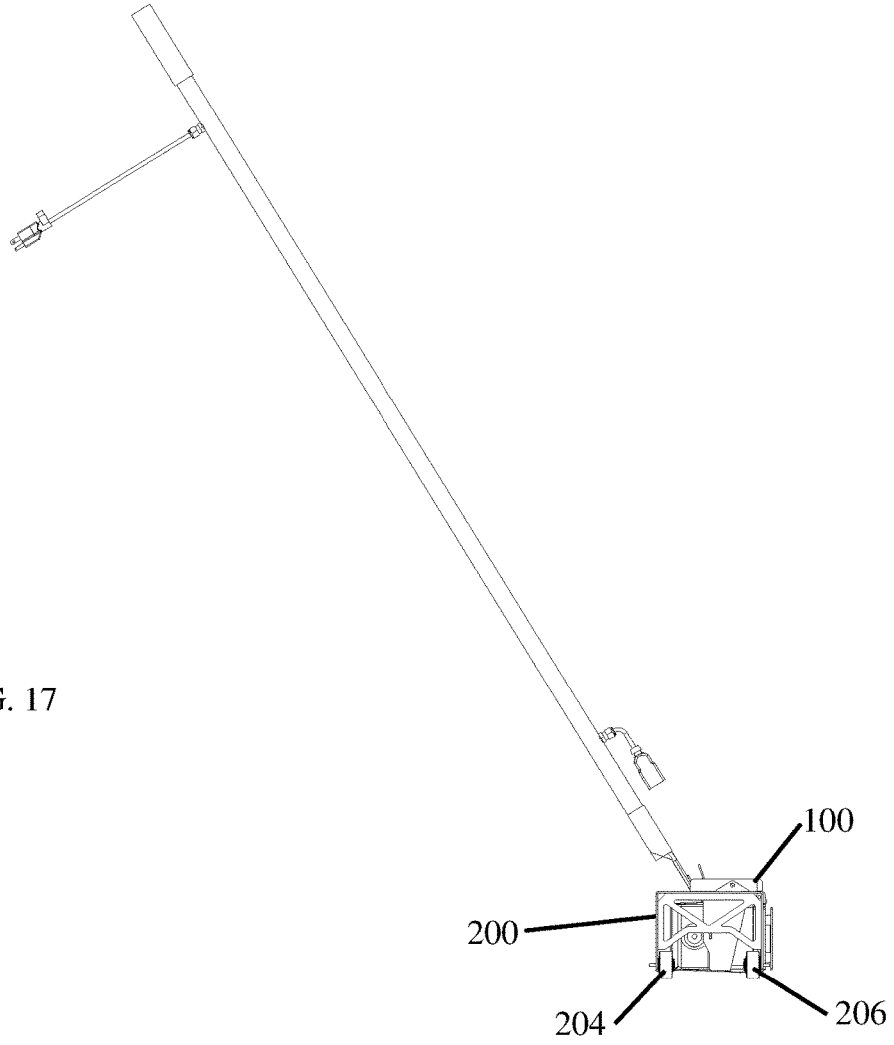
FIG. 17 is a left side view thereof.
Figure 18:
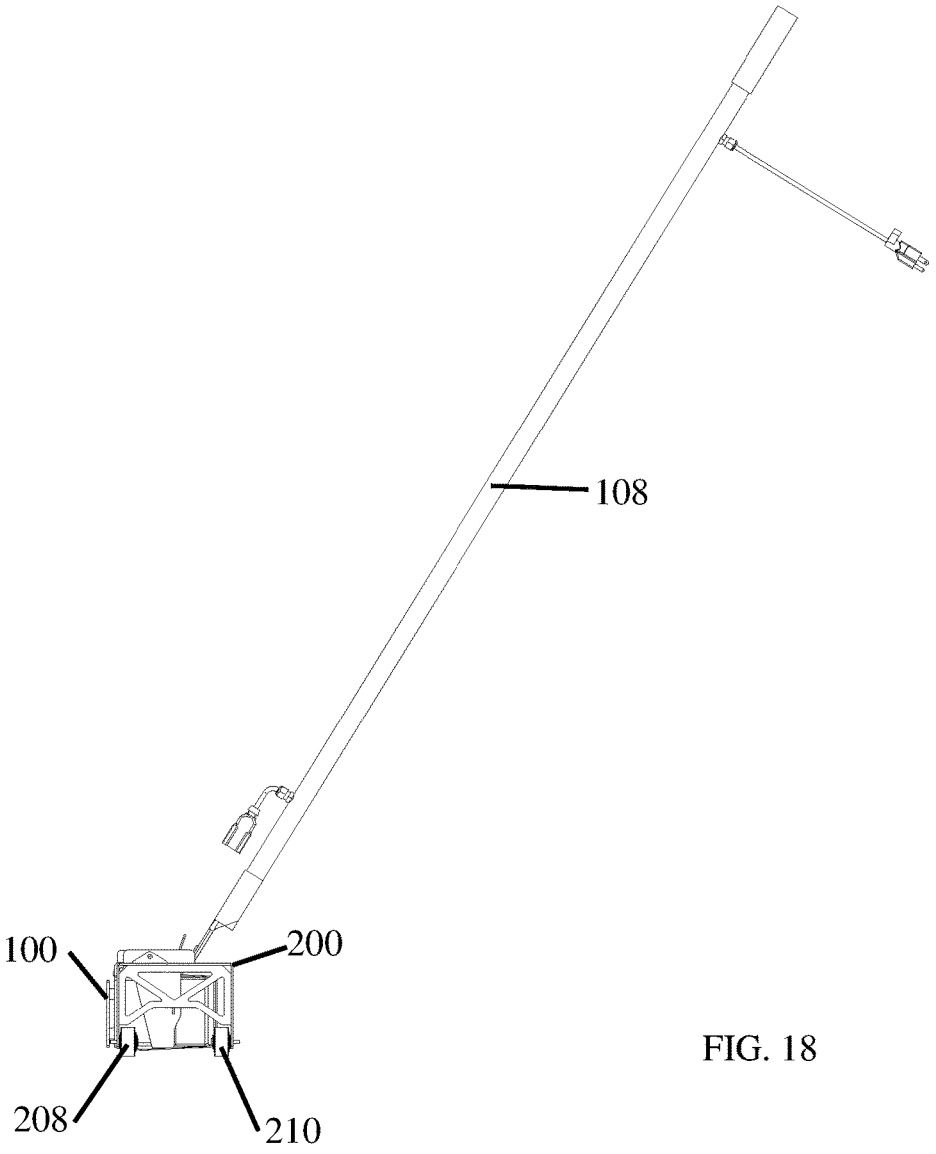
FIG. 18 is a right side view thereof.
Figure 19:
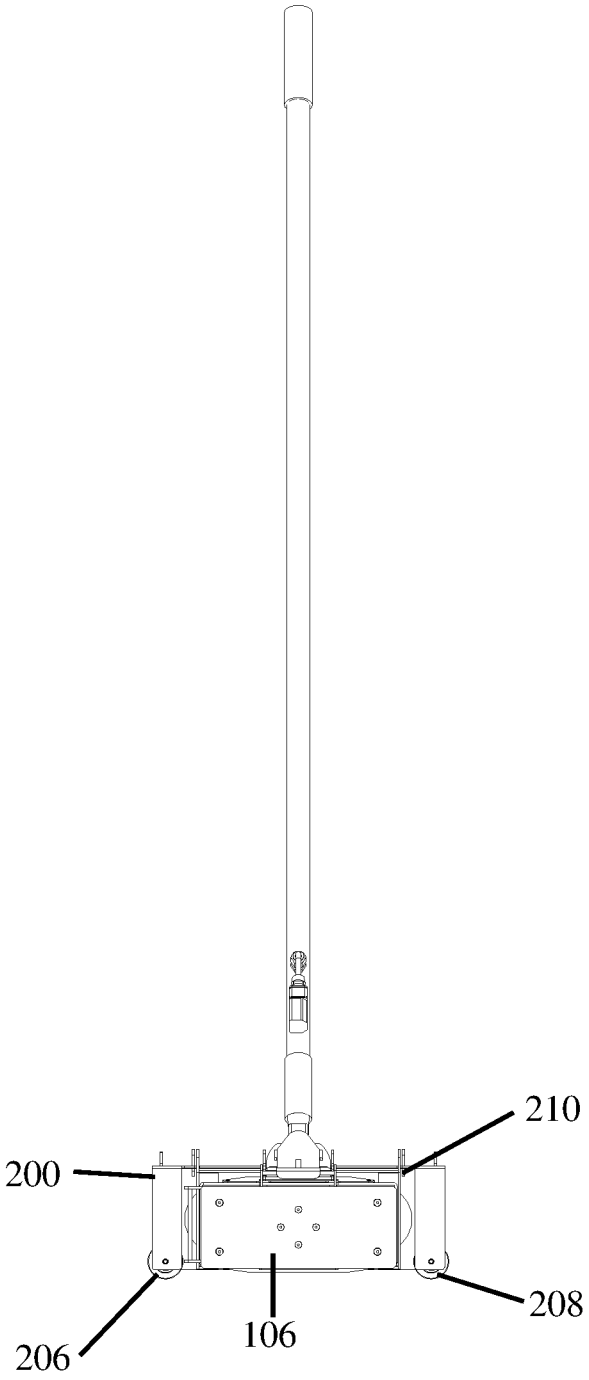
FIG. 19 is a front view thereof.
Figure 20:
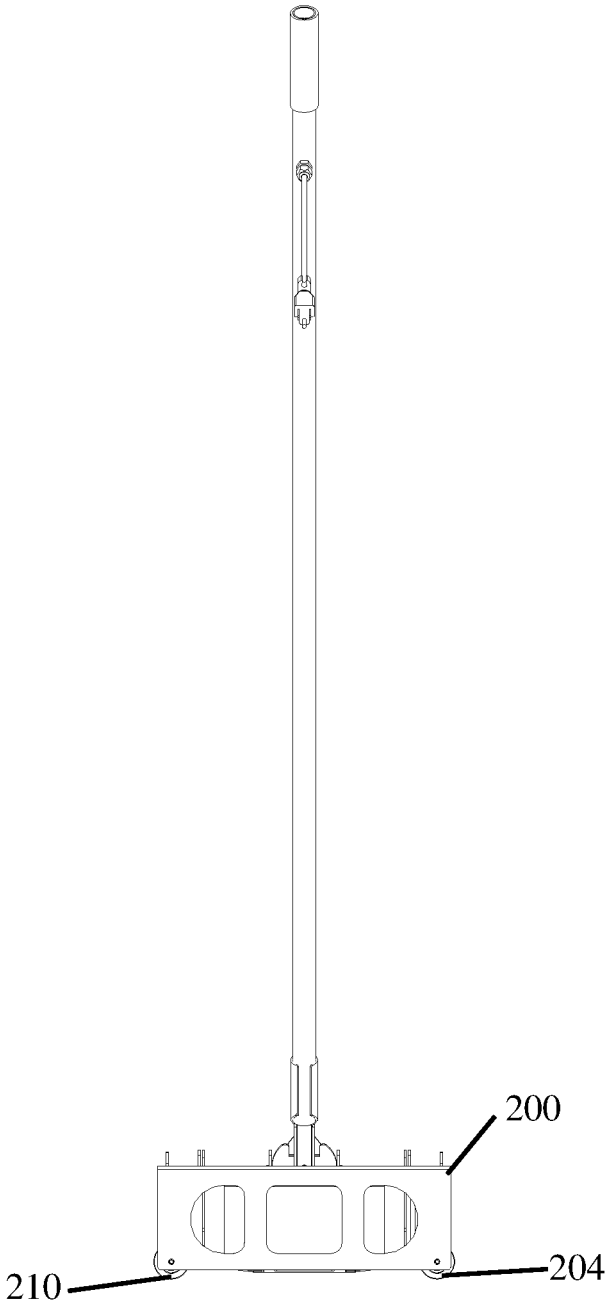
FIG. 20 is a rear view thereof.

FIG. 15 shows the attachment of the eccentric assembly 146 to the motor shaft 147. The shaft fastener 148 secures the eccentric assembly 146 to the driver plate 106.

FIGS. 16-32 show another embodiment of the present invention in which the floor machine 100 is oriented to the side and secured to a rolling attachment 200. The handle 108 secures to the rolling frame 202 with wheels 204, 205. The rolling frame 202 provides an opening in the front for placement of the driver plate.

FIGS. 16-20 show wheels 204, 206, 208, 210 attached to rolling attachment 200. The wheels are secured to the rolling attachment to allow movement in two directions, side to side. The placement of the handle 108 enables the user to exert a forward force on the driving plate 106 and the preparation body. Such a forward force presses the preparation body into the wall or baseboard to be cleaned. The wheels 204, 206, 208, 210 direct the rolling attachment 200 side to side to enable the user to traverse the wall with the preparation body.

Figure 21:
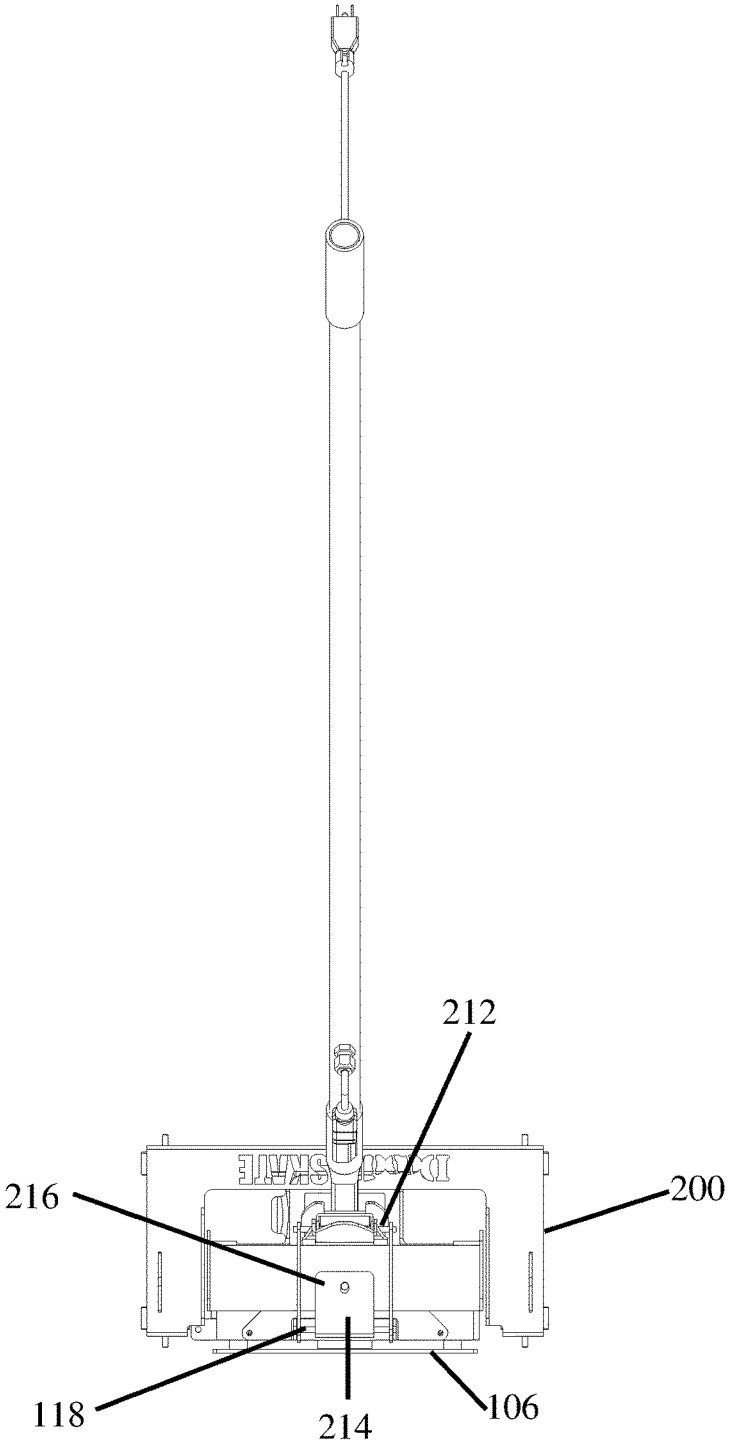
FIG. 21 is a top view thereof.

FIG. 21 shows the attachment of the floor machine 100 to the rolling attachment 200. The handle attaches to the attachment body 212 of the rolling attachment 200. Locking arm 214 is placed onto locking pin 216 to secure the attachment body 118 of the floor machine to the rolling attachment. The driving plate 106 extends forward from the rolling attachment 200 to allow the user to treat the wall and/or baseboards with the preparation body.

Figure 22:
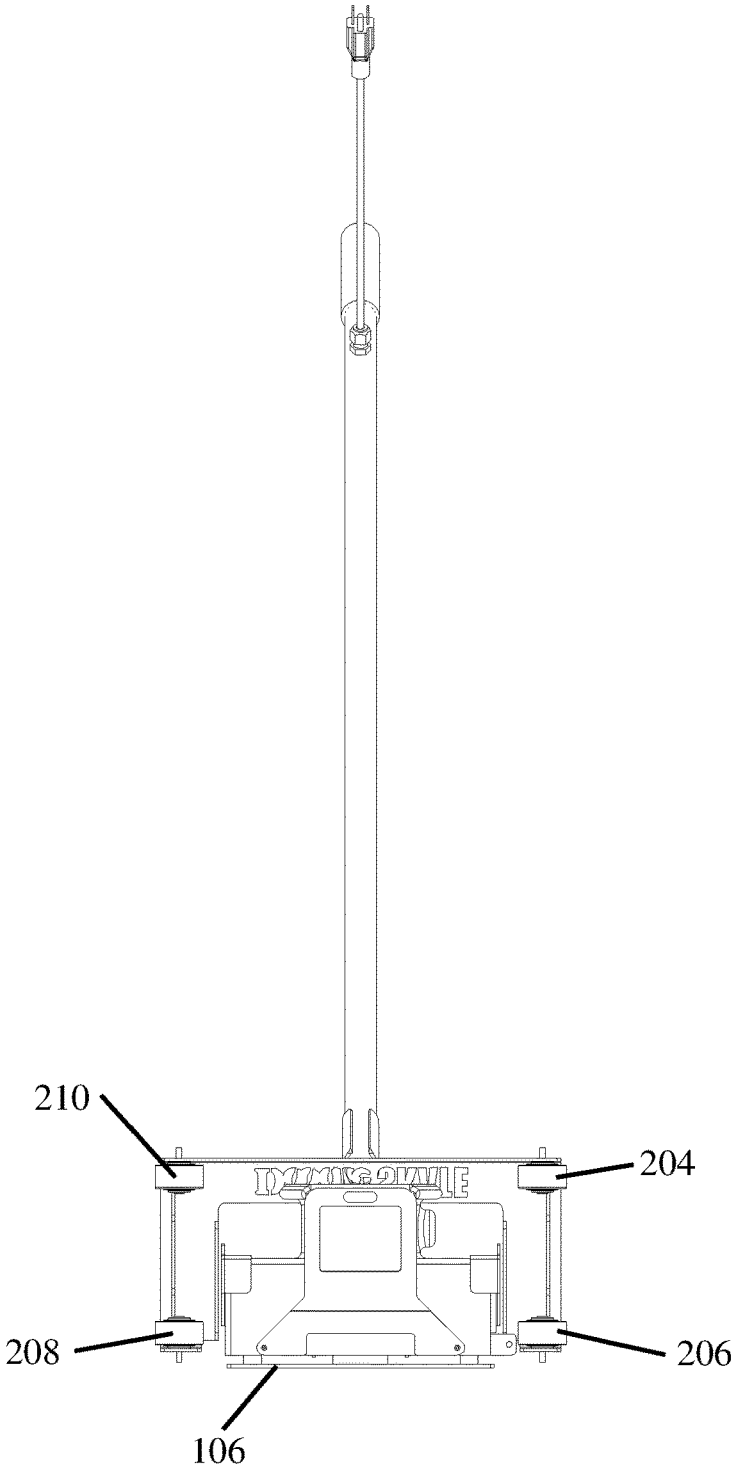
FIG. 22 is a bottom view thereof.
Figure 23:
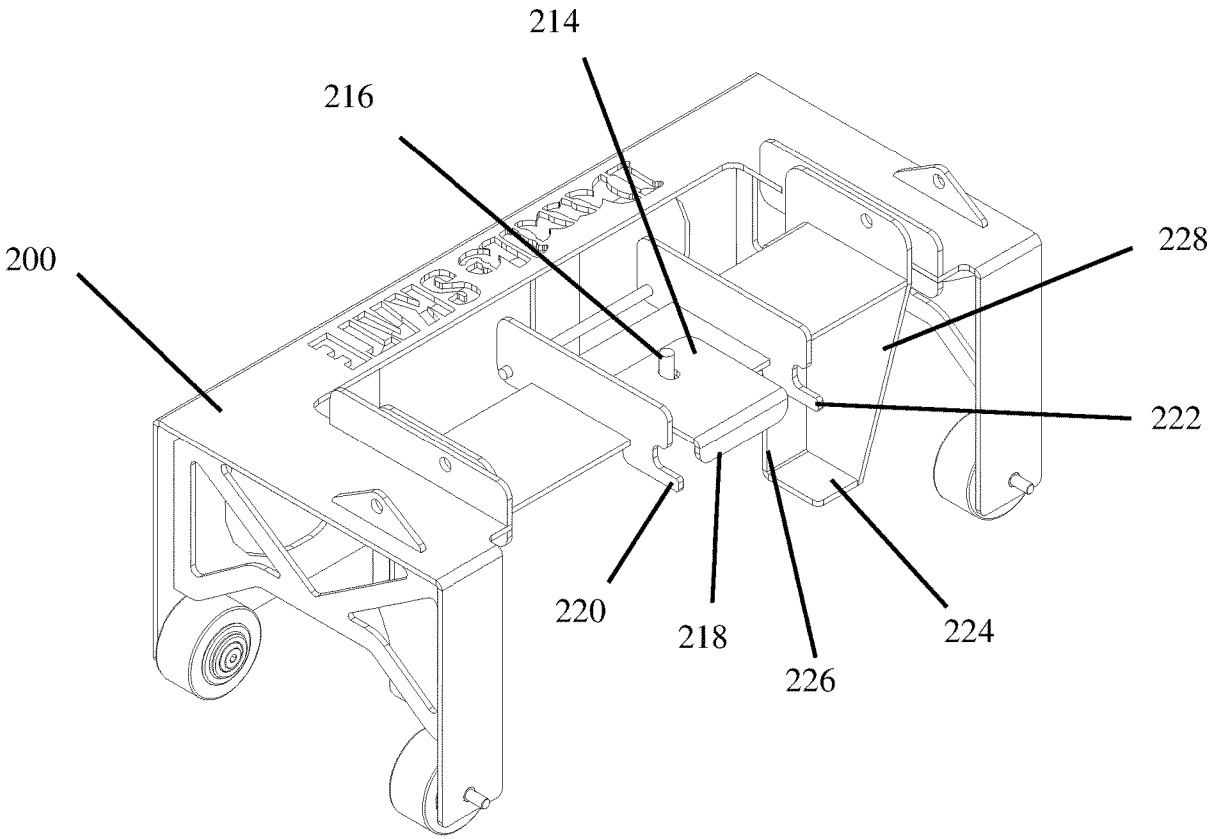
FIG. 23 is a perspective view of a rolling attachment of one embodiment of the present invention.
Figure 24:
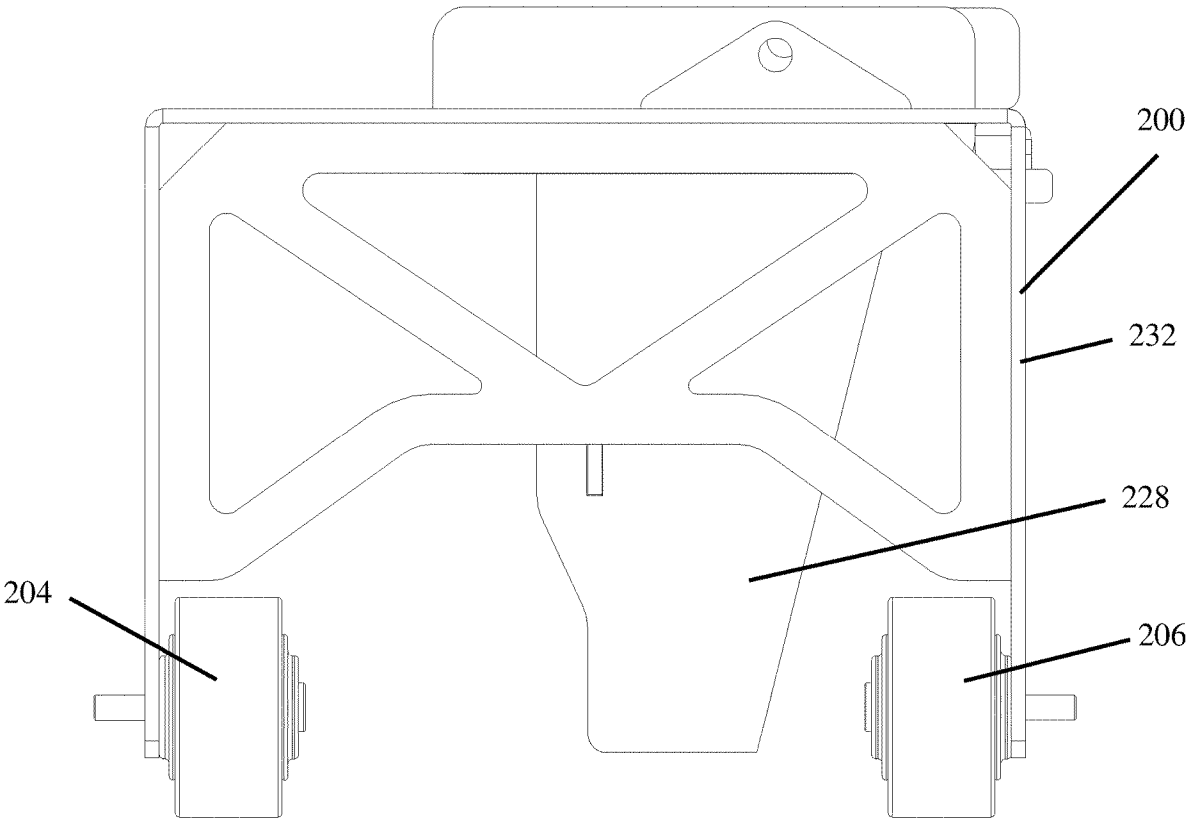
FIG. 24 is a left side view thereof, the right side view being a mirror image of the left side view.

FIG. 22 shows the attachment of wheels 204, 206, 208, 210 to the rolling attachment. In one embodiment, the wheels are attached in a fixed position to avoid pivoting of the wheels. Such attachment of the wheels 204, 206, 208, 210 assists with side to side movement for cleaning the walls and/or baseboards.

FIGS. 23-28 show the roller attachment 200 with the floor machine removed from the rolling attachment 200. Support body 228 positions the floor machine off of the ground and limits backwards movement. Support foot 224 maintains the floor machine above the ground to prevent dragging of the floor machine against the ground.

The user presses the floor machine into the wall and/or baseboard. The support leg 226 limits backwards movement of the floor machine. Therefore, the user can maintain the preparation body on the wall and/or baseboards without too much backward movement of the floor machine. The other side of rolling attachment 200 also provides a support body similar to support body 228.

The rolling attachment 200 also provides an upper attachment through support fingers 220, 222. Support fingers 220, 222 contact the attachment body 110. Locking arm 214 and locking finger 218 attach to locking pin 216 to secure attachment body 110 between the support fingers 220, 222 and locking finger 214 and locking arm 218.

Roller attachment 200 provides a front wall 232 and a rear wall 230. Wheels 204, 210 secure to rear wall 230. Wheel 206 secures to front leg 232. The support body 228 maintains the positioning of the cleaning body while in use.

Figure 25:
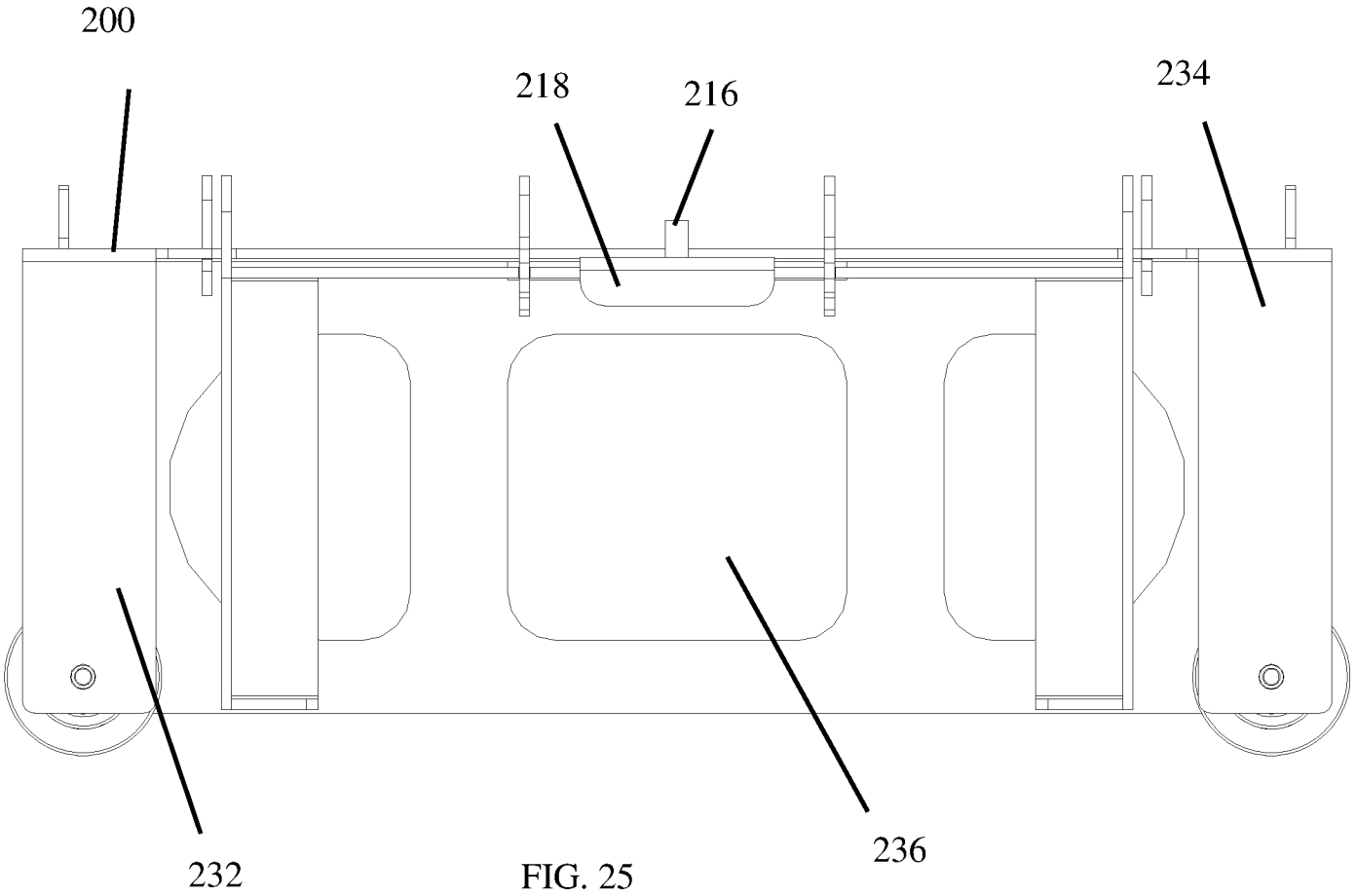
FIG. 25 is a front view thereof.

FIG. 25 shows the locking finger 218 attached to the locking pin 216. The locking finger 218 extends vertically downward to secure the attachment body to the rolling attachment 200. The front wheels secure to front legs 232, 234 to allow for movement from side to side. Opening 236 between front legs 232, 234 provides sufficient space for the driving plate and preparation body to contact the wall.

Figure 26:
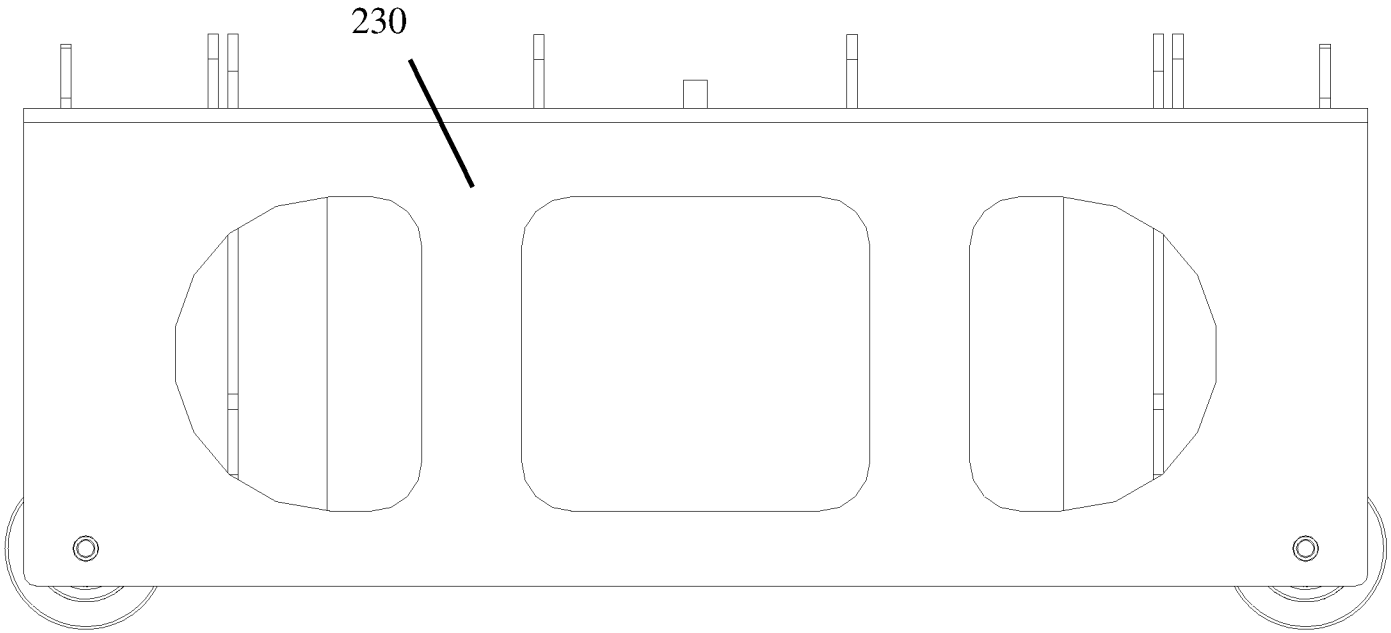
FIG. 26 is a rear view thereof.

FIG. 26 shows rear wall 230 and the attachment of the rear wheels to the rear wall 230.

Figure 27:
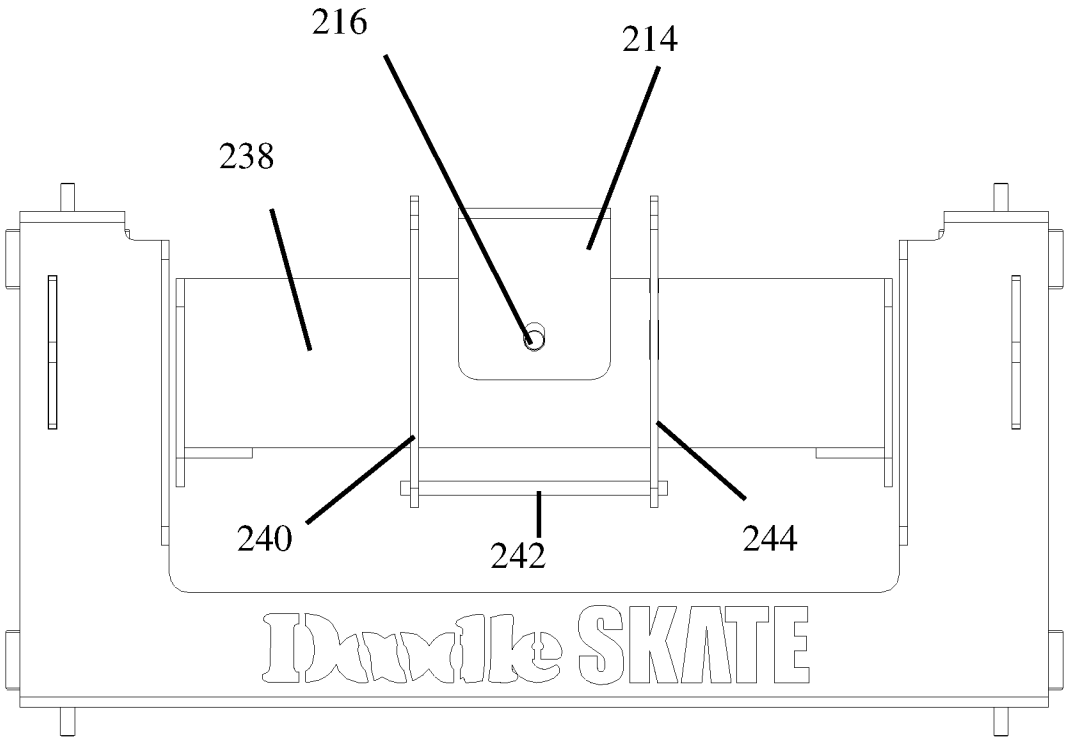
FIG. 27 is a top view thereof.
Figure 28:
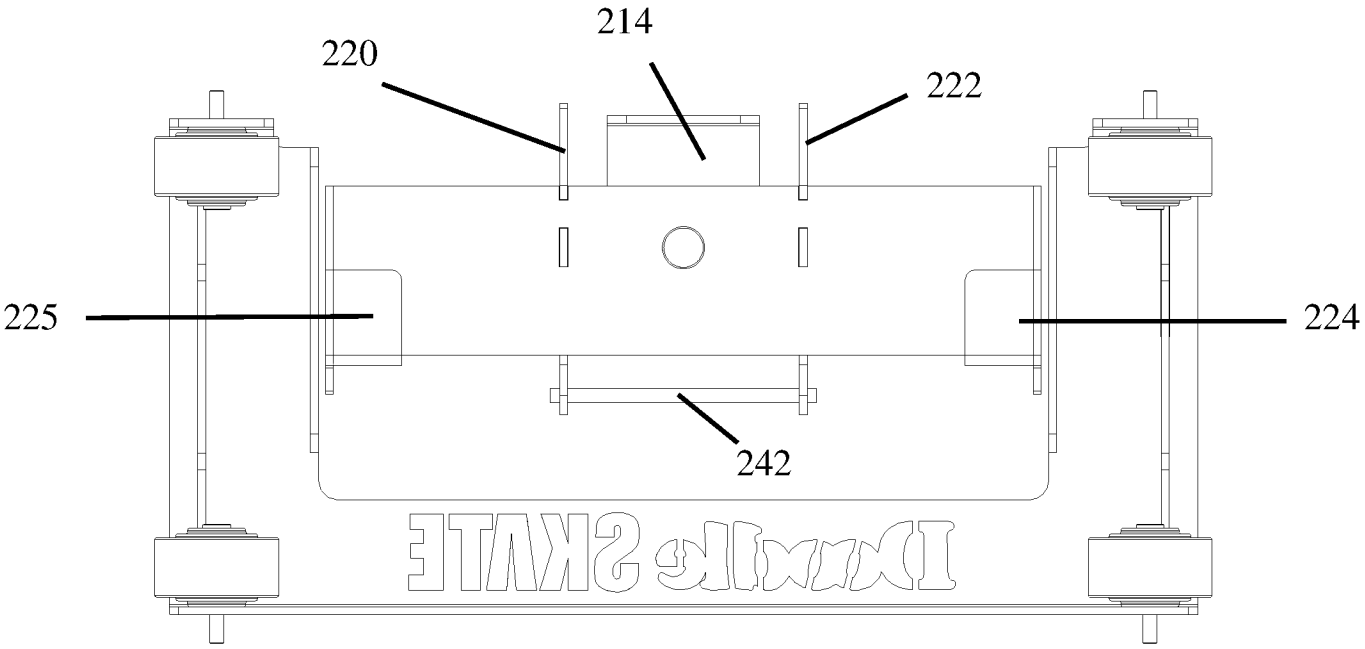
FIG. 28 is a bottom view thereof.

FIGS. 27 and 28 show the positioning of the locking pin 216 within the locking arm 214. The locking body 238 provides attachment shoulders 240, 244 for attachment body 242. The attachment body 242 provides an attachment neck similar to the attachment bodies described above.

FIGS. 27-28 also show the support fingers 220, 222 and support bodies 224, 225.

Figure 29:
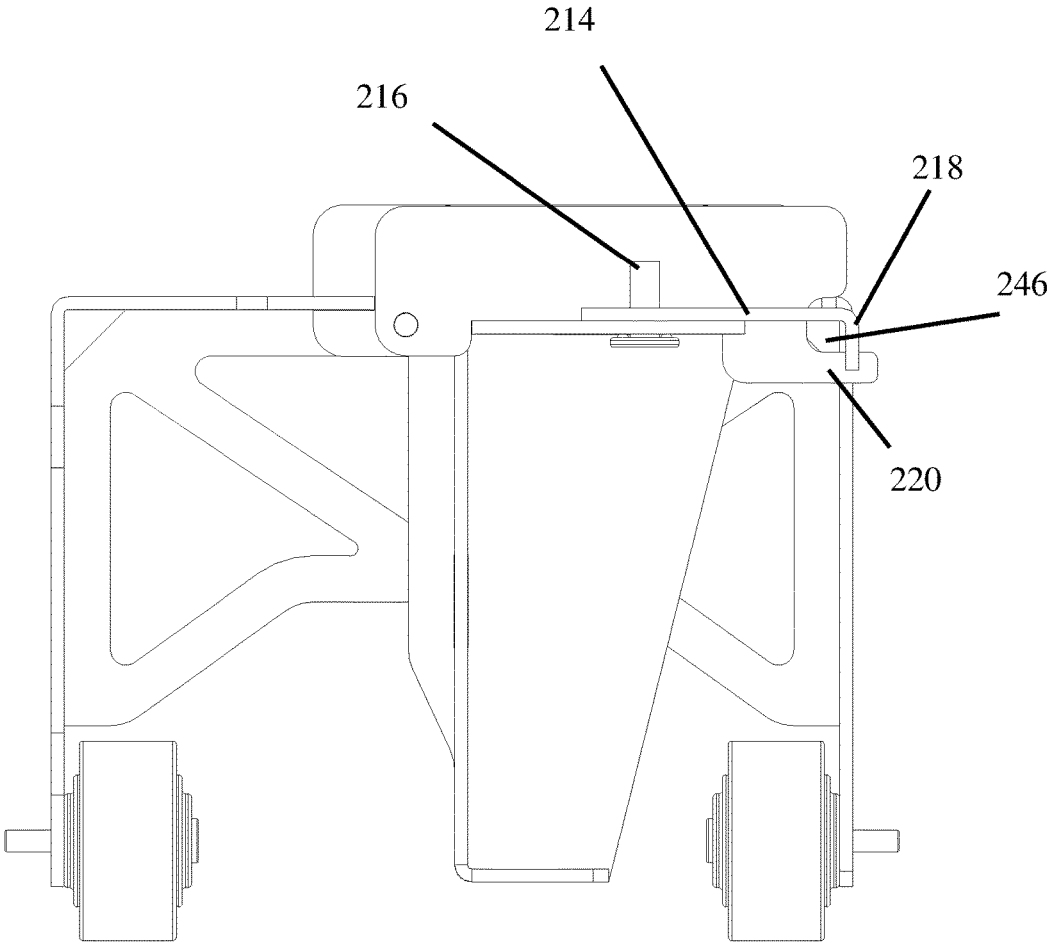
FIG. 29 is a sectional view thereof.

FIG. 29 shows the attachment aperture 246 formed by the support fingers 220, 222, locking arm 214, and locking finger 218. Locking pin 216 secures the locking arm 214 on to the rolling attachment to maintain the positioning of the locking arm 214 and locking finger 218. The locking finger 218 secures the attachment body of the floor machine within the attachment aperture 246 to secure the floor machine within the attachment aperture.

Figure 30:
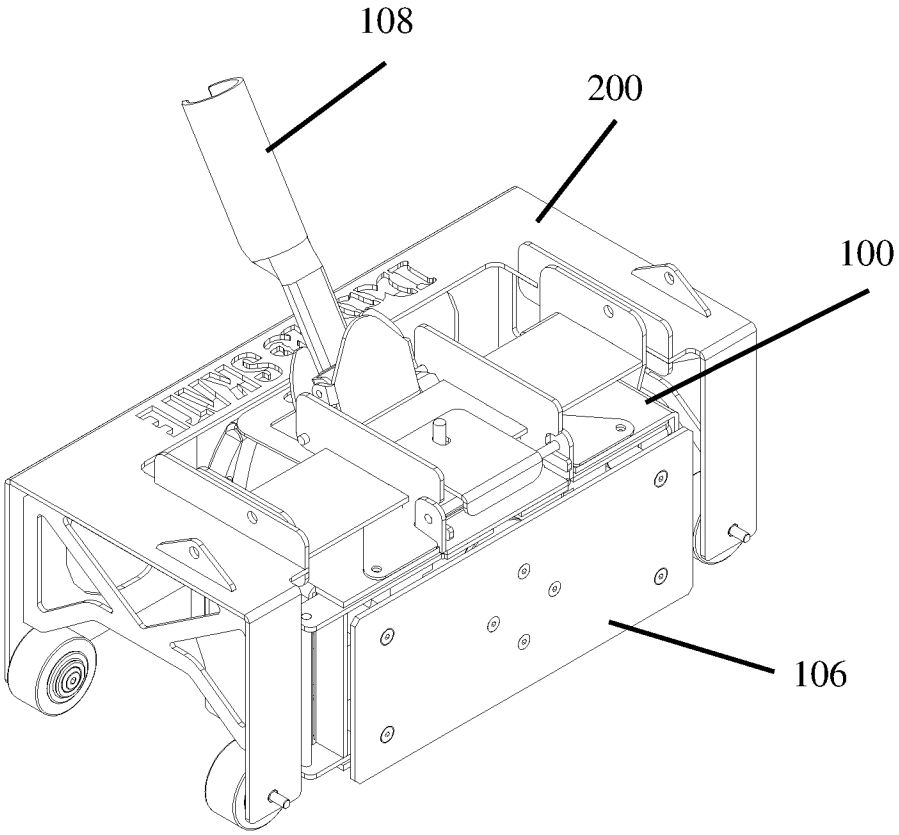
FIG. 30 is an environmental view thereof.

FIG. 30 shows handle 108 secures to the rolling attachment. The floor machine 100 is secured to the rolling attachment. As discussed above, the rolling attachment 200 provides space between the front legs for exposing the driver plate 106 and preparation body to the wall and or baseboards.

Figure 31:
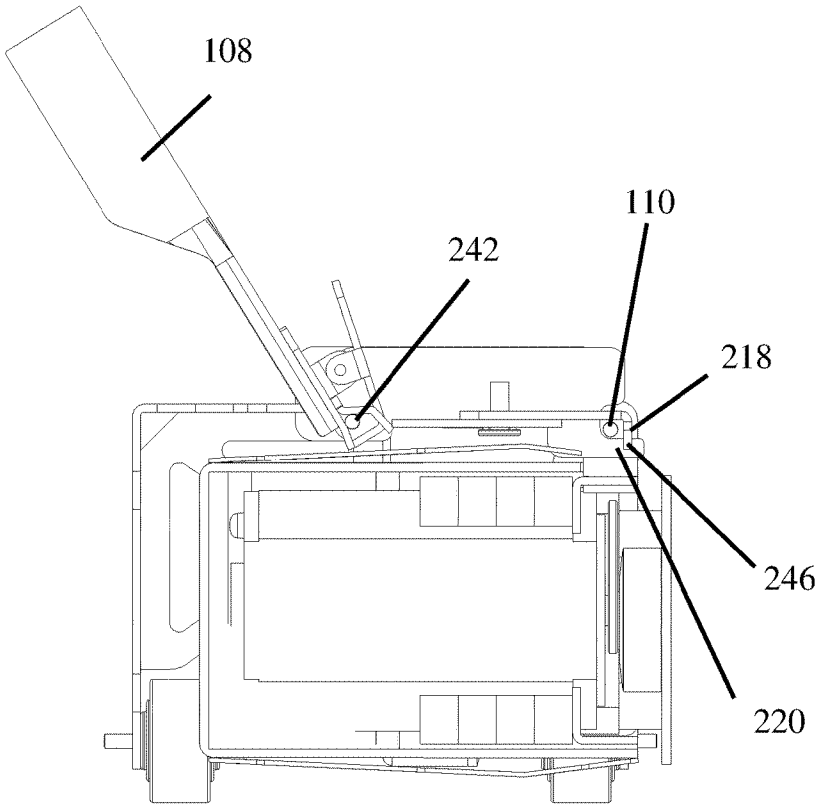
FIG. 31 is a sectional view thereof.

FIG. 31 shows the attachment of the handle 108 to the attachment body 242. The attachment of the handle to the attachment body is similar to the attachment of the handle to the attachment bodies of the floor machine described above.

Figure 32:
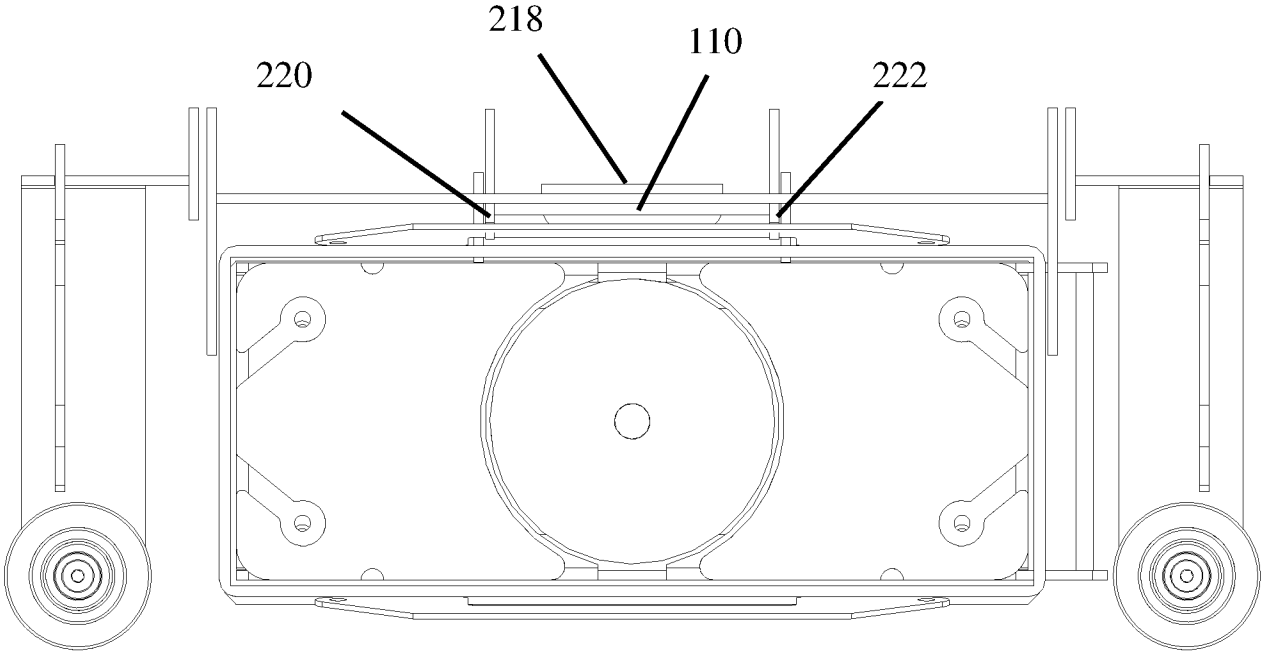
FIG. 32 is a sectional view thereof.

FIGS. 32-33 show the attachment of the floor machine to the rolling attachment. Attachment body 110 inserts into the attachment aperture 246. Attachment arm and attachment finger lift upwards from attachment pin. Attachment body 110 is placed onto support fingers 220, 222. The user then places the attachment arm and attachment finger 218 onto the attachment pin. The placement of the attachment arm and attachment finger on the attachment pin secures the attachment body into the attachment aperture 246. The user can then clean the baseboards and/or walls.

To remove the floor machine from the roller attachment, the user lifts the attachment finger 218 and attachment arm off of attachment pin. The user can then remove the floor machine from the support fingers 220, 222 and the roller attachment.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An apparatus for treating a surface with a preparation body wherein a handle releasably attaches to a housing storing a motor that agitates the preparation body to treat the surface, the apparatus comprising:

a front wall of the housing;

a rear wall of the housing;

a first side wall and a second side wall of the housing;

a rear attachment body extending outward from the rear wall;

a side attachment body secured to the side wall wherein the handle attaches to the housing at one of the attachment bodies;

wherein the length of the rear wall is greater than the length of the first side wall and the length of the second side wall;

an attachment neck of the rear attachment body extending longitudinally adjacent the rear wall; and a rear attachment aperture located between the attachment neck and the rear wall providing spacing between the attachment neck and the rear wall.

2. The apparatus of claim 1 further comprising:

an attachment head of the handle wherein the attachment head encompasses the attachment neck to attach the handle to the rear attachment body.

3. An apparatus for treating a surface with a preparation body wherein a handle releasably attaches to a housing storing a motor that agitates the preparation body to treat the surface, the apparatus comprising:

a front wall of the housing;

a rear wall of the housing;

a first side wall and a second side wall of the housing;

a rear attachment body extending outward from the rear wall;

a side attachment body secured to the side wall wherein the handle attaches to the housing at one of the attachment bodies;

wherein the length of the rear wall is greater than the length of the first side wall and the length of the second side wall;

an attachment neck of the rear attachment body extending longitudinally adjacent the rear wall; and a side attachment aperture located between the attachment neck and the side wall providing spacing between the attachment neck and the side wall.

4. The apparatus of claim 3 further comprising:

an attachment head of the handle wherein the attachment head encompasses the attachment neck to attach the handle to the side attachment body.

5. An apparatus for treating a surface with a preparation body wherein a handle releasably attaches to a housing storing a motor that agitates the preparation body to treat the surface, the apparatus comprising:

a front wall of the housing;

a rear wall of the housing;

a first side wall and a second side wall of the housing;

a rear attachment body extending outward from the rear wall;

a side attachment body secured to the side wall wherein the handle attaches to the housing at one of the attachment bodies;

wherein the length of the rear wall is greater than the length of the first side wall and the length of the second side wall;

an attachment neck of the rear attachment body extending longitudinally adjacent the rear wall;

a rear attachment aperture located between the attachment neck and the rear wall providing spacing between the attachment neck and the rear wall;

an attachment neck of the side attachment body extending longitudinally adjacent the side wall; and a side attachment aperture located between the attachment neck and the side wall providing spacing between the attachment neck and the side wall.

6. The apparatus of claim 5 further comprising:

an attachment head of the handle wherein the attachment head encompasses the attachment neck when attaching the handle to the rear attachment body, the attachment head encompasses the attachment neck when attaching the handle to the side attachment body.

7. An apparatus for treating a surface with a preparation body wherein a handle releasably attaches to a housing storing a motor that agitates the preparation body to treat the surface, the apparatus comprising:

a front wall of the housing;

a rear wall of the housing;

a first side wall and a second side wall of the housing wherein the length of the first side wall and the length of the second side wall is less than the length of the rear wall;

a rear attachment body extending outward from the rear wall;

a side attachment body secured to the side wall wherein the handle attaches to at least one of the attachment bodies; and a driving plate secured to the housing wherein the preparation body attaches to the driving plate;

the motor secured to the rear attachment body and the side attachment body;

a shaft of the motor extending vertically downward;

an eccentric assembly secured to the shaft;

the driving plate secured to the eccentric assembly wherein the eccentric assembly offsets the driving plate in relation to the shaft, the driving plate located below the motor;

an attachment neck of the side attachment body extending longitudinally adjacent the side wall; and a side attachment aperture located between the attachment neck and the side wall providing spacing between the attachment neck and the side wall.

8. The apparatus of claim 7 further comprising:

an attachment head of the handle wherein the attachment head encompasses the attachment neck when attaching the handle to the side attachment body.

9. An apparatus for treating a surface with a preparation body wherein a handle releasably attaches to a housing storing a motor that agitates the preparation body to treat the surface, the apparatus comprising:

a front wall of the housing;

a rear wall of the housing;

a first side wall and a second side wall of the housing;

a rear attachment body extending outward from the rear wall;

a side attachment body secured to the side wall wherein the handle attaches to the housing at one of the attachment bodies;

a driving plate secured to the housing wherein the preparation body attaches to the driving plate; and a bottom surface of the driving plate wherein the bottom surface forms a rectangle with sides of differing length wherein attachment of the handle to the rear attachment body adjusts the orientation of the driving plate in relation to the handle to a first orientation and attaching the handle to the side attachment body adjusts the orientation of the driving plate in relation to the handle to a second orientation wherein the first orientation is different than the second orientation.

10. The apparatus of claim 9 further comprising:

the motor secured to the rear attachment body and the side attachment body;

a shaft of the motor extending vertically downward;

an eccentric assembly secured to the shaft;

the driving plate secured to the eccentric assembly wherein the eccentric assembly offsets the driving plate in relation to the shaft.

11. The apparatus of claim 10 further comprising:

an attachment neck of the rear attachment body extending longitudinally adjacent the rear wall;

a rear attachment aperture located between the attachment neck and the rear wall providing spacing between the attachment neck and the rear wall;

an attachment neck of the side attachment body extending longitudinally adjacent the side wall;

a side attachment aperture located between the attachment neck and the side wall providing spacing between the attachment neck and the side wall; and an attachment head of the handle wherein the attachment head encompasses the attachment neck when attaching the handle to the rear attachment body, the attachment head encompasses the attachment neck when attaching the handle to the side attachment body.

* * * * *